US007050075B2

(12) United States Patent
Awamoto et al.

(10) Patent No.: US 7,050,075 B2
(45) Date of Patent: May 23, 2006

(54) DATA CONVERSION CIRCUIT AND COLOR IMAGE DISPLAY APPARATUS

(75) Inventors: Kenji Awamoto, Kawasaki (JP); Katsuya Irie, Kawasaki (JP); Kunio Takayama, Kawasaki (JP); Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 236 days.

(21) Appl. No.: 10/347,411

(22) Filed: Jan. 21, 2003

(65) Prior Publication Data

US 2003/0174151 A1 Sep. 18, 2003

(30) Foreign Application Priority Data

Mar. 15, 2002 (JP) ..... 2002-072141

(51) Int. Cl.
*G09G 5/10* (2006.01)

(52) U.S. Cl. ..... 345/690; 345/591; 345/600; 345/603; 345/604; 345/606; 345/615; 345/643; 345/660; 345/669; 345/694; 345/698; 345/699

(58) Field of Classification Search ..... 345/591, 345/600, 603–604, 606, 615, 643, 660, 669, 345/690, 694, 698–699
See application file for complete search history.

(56) References Cited

U.S. PATENT DOCUMENTS

| | | | | |
|---|---|---|---|---|
| 5,559,529 | A | 9/1996 | Maher | |
| 5,668,569 | A * | 9/1997 | Greene et al. | 345/103 |
| 6,243,055 | B1 * | 6/2001 | Fergason | 345/32 |
| 6,563,511 | B1 * | 5/2003 | Yeh et al. | 345/611 |
| 6,768,485 | B1 * | 7/2004 | Awamoto et al. | 345/204 |

FOREIGN PATENT DOCUMENTS

| | | |
|---|---|---|
| EP | 0367418 | 5/1990 |
| EP | 1143404 | 10/2001 |
| JP | 09-050768 | 2/1997 |

OTHER PUBLICATIONS

European Search Report dated Sep. 8, 2005 for application No. 03250276.7-2205 (4 pgs).

* cited by examiner

*Primary Examiner*—Sumati Lefkowitz
*Assistant Examiner*—Alexander S. Beck
(74) *Attorney, Agent, or Firm*—Staas & Halsey LLP

(57) ABSTRACT

A data conversion circuit is provided for displaying a high definition image whose resolution is different from that of a display screen having a cell arrangement that is not a square arrangement. The data conversion circuit performs addition operation with weighting that is also resolution conversion of the integer ratio M:N and data correction for improving a linear display quality for input image data.

5 Claims, 20 Drawing Sheets

FIG. 12A RESOLUTION CONVERSION OF 3 : 2
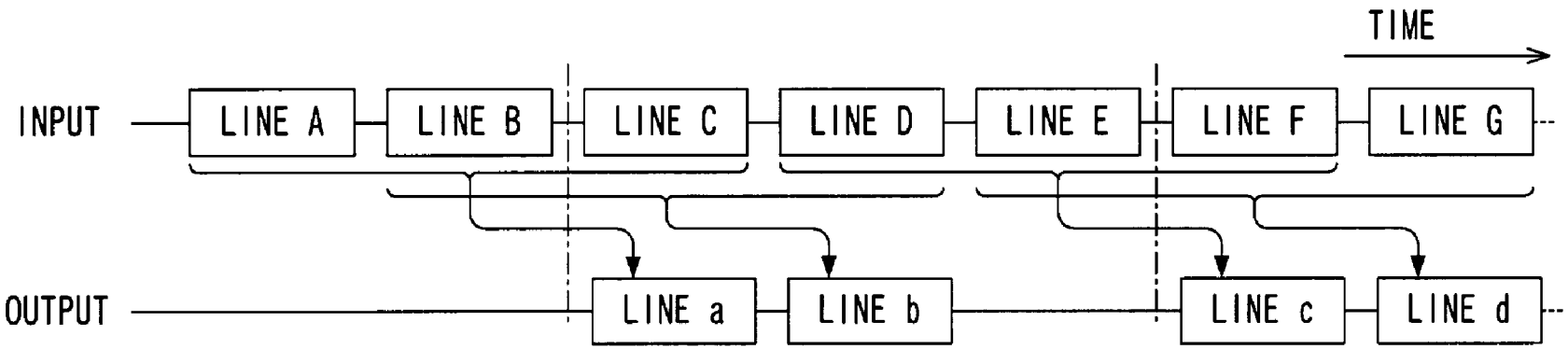
FIG. 12B RESOLUTION CONVERSION OF 2:3
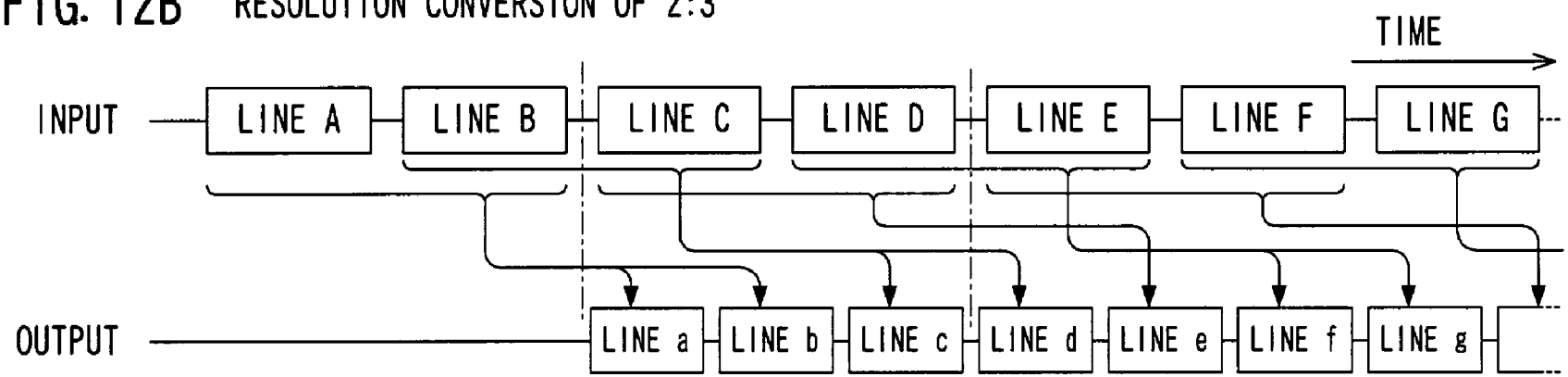

DATA CONVERSION CIRCUIT AND COLOR IMAGE DISPLAY APPARATUS

BACKGROUND OF THE INVENTION

1. Field of the Invention

The present invention relates to a data conversion circuit and a color image display apparatus for displaying a square arrangement image in a non-square cell arrangement screen, which is particularly suitable for a display using a plasma display panel (PDP).

2. Description of the Prior Art

Recently, high image quality of a television set or a computer output is widely spread, and a display apparatus is desired that supports a high definition display for various kinds of images including a natural image or a character image.

As a display device having a large screen, a surface discharge format AC type PDP is put into commercial production. The surface discharge format is a format in which first and second display electrodes to be anodes and cathodes in display discharge for securing luminance are arranged in parallel on a front or a back substrate. As an electrode matrix structure for the surface discharge type PDP, a "three-electrode structure" is common in which address electrodes are arranged so as to cross the display electrode pairs. For a display, one of the display electrode pair is used as a scan electrode for row selection in a matrix display, and address discharge is generated between the scan electrode and the address electrode so that addressing is performed for controlling wall charge in accordance with display contents. Hereinafter, a pixel array in the row direction of an image as well as a cell array in the row direction of a display screen is called a "line". In addition, a line of the display screen is called a "display line" if discrimination is necessary.

In Japanese unexamined patent publication No. 9-50768, a deformed stripe partition structure is proposed in which the three-electrode surface discharge type PDP has plural band-like partitions that divide a discharge space in the direction along the display line (usually in the horizontal direction) and meander in a regular manner so as to prevent discharge interference in the direction along the column (usually in the vertical direction). Each of the partitions defines a column space with a neighboring partition. The column space has wide portions and narrow portions that are arranged alternately. Positions of the wide portions in the neighboring columns are shifted from each other, and a cell is formed in each of the wide portions. One of red, green and blue fluorescent materials is arranged in each column space for a color display so that light emission color is different between neighboring column spaces. The three colors are arranged in a so-called delta arrangement (a delta tricolor arrangement). Since the delta arrangement has a cell width larger than one third of a pixel pitch in the display line direction and an aperture ratio larger than a square arrangement, a display with higher luminance can be achieved. Conventionally, in a color image display using a delta arrangement PDP, each of the display lines is made up of cells each of which is selected fixedly from the cell array along each address electrode.

In a display apparatus having a usual square cell arrangement display device, resolution conversion is performed for adjusting an image size to a display device so as to display various sizes of input images. The size conversion in the horizontal direction is performed by adjusting timing of a sampling clock when converting an analog image signal into digital image data. The size conversion in the vertical direction is performed by interpolation operation on the basis of data of plural lines. For example, data of a new line that are generated from a mean value of data of two neighboring lines are inserted between the original two lines, so that the number of lines can be doubled. In addition, the number of lines can be reduced in half by outputting the generated data of the line instead of the original two lines.

Conventionally, there was a problem that an unnatural display is produced because of the following two phenomena when adopting a delta arrangement display screen.

(1) Since positions of neighboring cells are shifted from each other in the vertical direction, a line extending in the horizontal direction looks like a zigzag line in the display.

(2) Pitches of lighted cells are not uniform when displaying a line slanting to the horizontal direction and the vertical direction.

SUMMARY OF THE INVENTION

An object of the present invention is to realize a high definition display of an image whose resolution is different from that of a display screen having a non-square cell arrangement. Another object is to realize plural kinds of resolution conversions by an inexpensive circuit.

According to one aspect of the present invention, display data of each cell of the display screen are generated by an operation of adding plural pixel data in the input image with weighting, i.e., by a convolution operation. The weight in the operation is set so that the resolution conversion in an integer ratio M:N and data correction that improves line display quality are performed simultaneously. The resolution conversion is a process in which the number of pixels either in the vertical direction or in the horizontal direction is changed. The data correction is a process in which luminance of a pixel in the input image is dispersed to neighboring cells having the same color, so that the problem of the zigzag appearance of a line can be relieved. Since the resolution conversion and the data correction are performed simultaneously, a clearer display can be achieved compared with the case where the resolution conversion and the data correction are performed in series.

Since the operation can be changed by switching the weight in the convolution operation, a ratio of the resolution conversion can be changed easily. The display apparatus comprising a circuit for deciding a resolution of an input image and a controller for switching the weight in accordance with a result of the decision can display various kinds of images such as VGA, XGA or a high-definition TV.

The cell arrangement in which the positions of cells are shifted from each other in the column direction between neighboring cell arrays having the same color is not a square arrangement. In the display device having this arrangement, it is necessary not to perform the same operation for all cells of the display screen but to perform different operations for two groups of cells, or to perform the operation only for one group. Therefore, the weight (the coefficient of the operation) is switched for each group in the operation.

BRIEF DESCRIPTION OF THE DRAWINGS

FIGS. 12A and 12B show data conversion operation timings.

DESCRIPTION OF THE PREFERRED EMBODIMENTS

Hereinafter, the present invention will be explained more in detail with reference to embodiments and drawings.

[General Outline of Color Image Display Apparatus]

Figure 1:
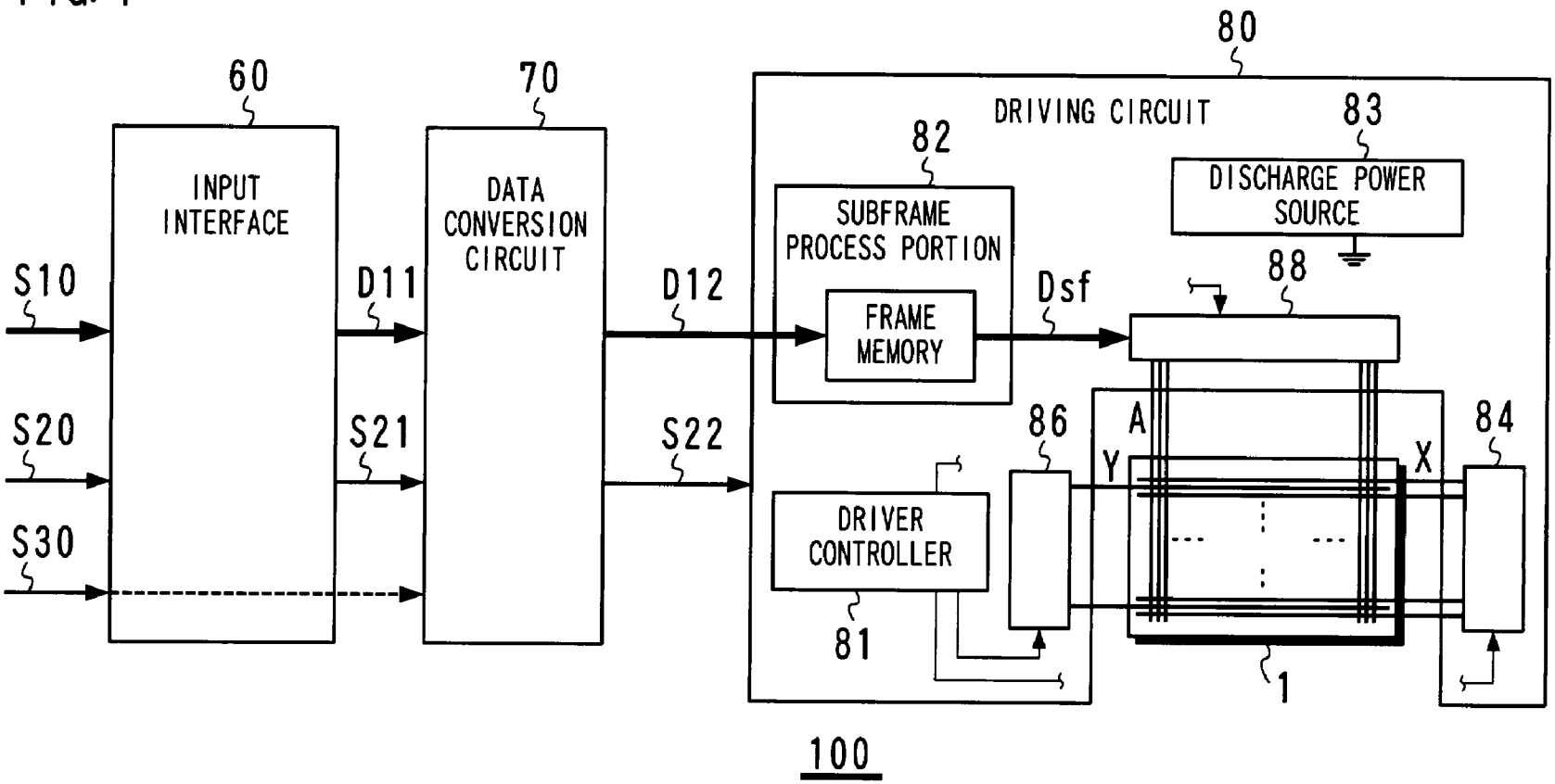
FIG. 1 is a block diagram of a display apparatus according to the present invention.

FIG. 1 is a block diagram of a display apparatus according to the present invention. The display apparatus 100 includes a surface discharge AC type PDP 1 having a display screen that is not a square arrangement, a driving circuit 80 for supplying a power to cells of the PDP 1, an input interface 60 for receiving signals from an image output device and a data conversion circuit 70 that is an element unique to the present invention. The display apparatus 100 is used as a wall-hung television set, a monitor display of a computer system or others.

In the PDP 1, display electrodes X and display electrodes Y are arranged on the same substrate for generating display discharge, and address electrodes A are arranged so as to cross the display electrodes X and display electrodes Y. The display electrodes X and the display electrodes Y extend in the horizontal direction of the display screen, and neighboring display electrodes X and Y constitute an electrode pair for generating surface discharge. The electrode pair defines one display line in the display screen. Every display electrode except the ends of the arrangement works for two display lines (an odd line and an even line), while the display electrode at each end works for one display line. The display electrode Y is used as a scan electrode for line selection in addressing.

The driving circuit 80 includes a driver controller 81, a subframe process portion 82, a discharge power source 83, an X-driver 84, a Y-driver 86 and an A-driver 88. The driving circuit 80 is supplied with frame data D12 and a synchronizing signal S22 from the data conversion circuit 70. The subframe process portion 82 converts the frame data D12 from the previous stage into subframe data Dsf for a gradation display. The subframe data Dsf indicate whether a cell is to be lighted or not in each of plural subframes (a binary image) of a frame (a multivalued image), more specifically whether address discharge is necessary or not. The X-driver 84 is potential setting means for the display electrode X. The Y-driver 86 includes a scan circuit and can perform both individual potential control and batch potential control for the display electrode Y. The scan circuit is potential setting means for line selection in addressing. The address driver 88 controls potential of the address electrode A in accordance with the subframe data Dsf.

The input interface 60 performs analog-to-digital conversion and gamma correction for an input image signal S10. In the analog-to-digital conversion, sample timing is adjusted so that the number of pixels in one line of the input image, i.e., resolution in the horizontal direction is adjusted to the number of cells of the PDP 1. The gamma correction is a process in which data value is adapted to luminance reproduction characteristic of the PDP 1. Furthermore, the input interface 60 includes a timing controller and generates a synchronizing signal S21 that is necessary for operation of later stage in accordance with a synchronizing signal S20 from an external device. A user selection signal S30 is given to the data conversion circuit 70 without any change. The data conversion circuit 70 performs image processing for displaying an input image of the square arrangement on a display screen that is not a square arrangement. A structure of the data conversion circuit 70 and the image processing will be explained later in detail.

Figure 2:
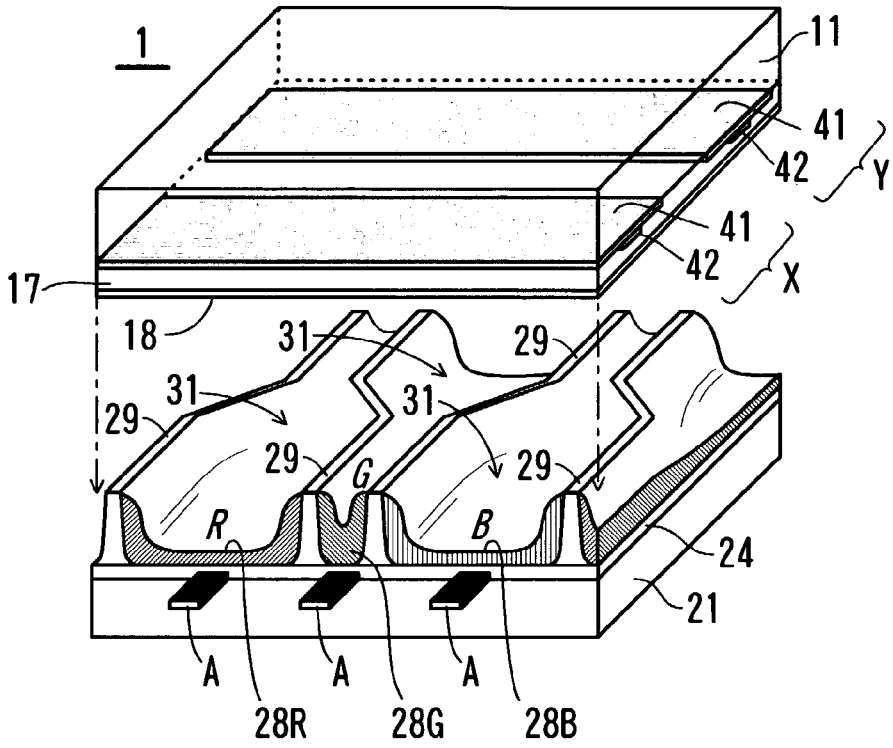
FIG. 2 is a diagram showing a cell structure of a PDP according to the present invention.
Figure 3:
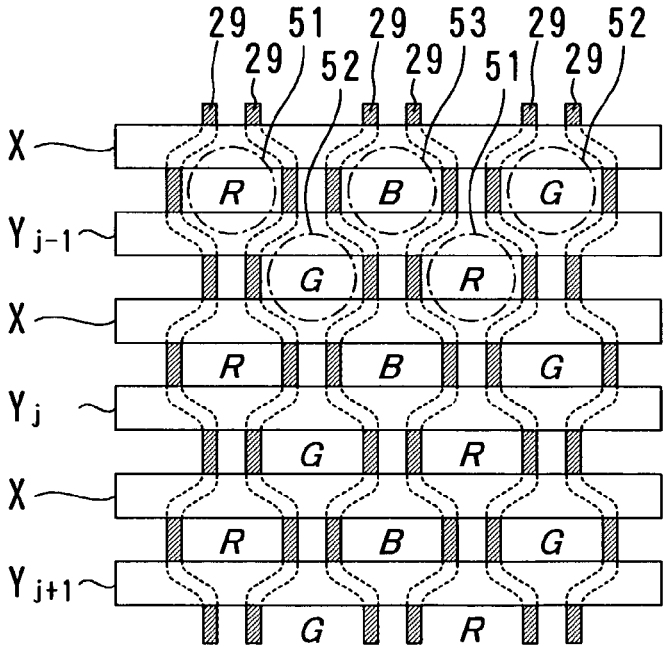
FIG. 3 is a diagram showing a partition pattern.

FIG. 2 is a diagram showing a cell structure of a PDP according to the present invention. FIG. 3 is a diagram showing a partition pattern. In FIG. 3, a suffix indicating an arrangement order is added to the reference letter "Y" of the display electrode Y.

The PDP 1 includes a pair of substrate structure bodies (cell structuring elements are arranged on a substrate of the substrate structure body). In each cell that constitutes the display screen, a pair of display electrodes X and Y crosses the address electrodes A. The display electrodes X and Y are arranged on the inner surface of the front glass substrate 11, and each of them includes a transparent conductive film 41 and a metal film (a bus electrode) 42. The display electrodes X and Y are covered with a dielectric layer 17, whose surface is coated with magnesia (MgO) that makes a protection film 18. The address electrodes A are arranged on the inner surface of the back glass substrate 21 and are covered with a dielectric layer 24. On the dielectric layer 24, meandering band-like partitions 29 having the height of approximately 150 microns are arranged so that one partition 29 corresponds to an arrangement gap of the address electrodes A. These partitions 29 divide a discharge space along the horizontal direction at a constant pitch. A column space 31 that is a discharge space defined by neighboring partitions is continuous over all display lines. Fluorescent material layers 28R, 28G and 28B of R (red), G (green) and B (blue) colors for a color display are disposed so as to cover the inner surface of the back side including upper portions of the address electrodes A and side surfaces of the partition 29. The Italic letters (R, G and B) in FIGS. 2 and 3 indicate light emission colors of the fluorescent materials. The fluorescent material layers 28R, 28G and 28B are excited locally by ultraviolet rays emitted by a discharge gas and emit light.

As shown in FIG. 3, each of the partitions 29 meanders so as to form a column space in which wide portions and narrow portions are arranged alternately. Between neighboring column spaces, the positions of the wide portions in the column direction are shifted by a half of the cell pitch in the column direction. The cells are formed in the wide portions, and the cells 51, 52 and 53 of one display line are indicated by dot-dashed circles as types in FIG. 3. The display line is a set of cells to be lighted when a horizontal line with a minimum width (one pixel width) is displayed.

Figure 4:
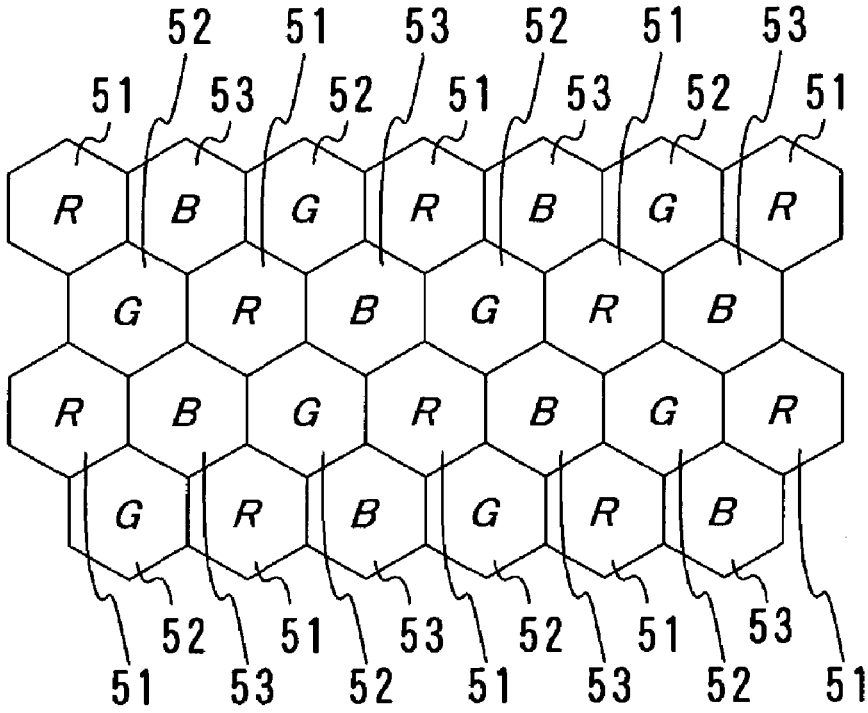
FIG. 4 is a schematic diagram of a cell arrangement.
Figure 5:
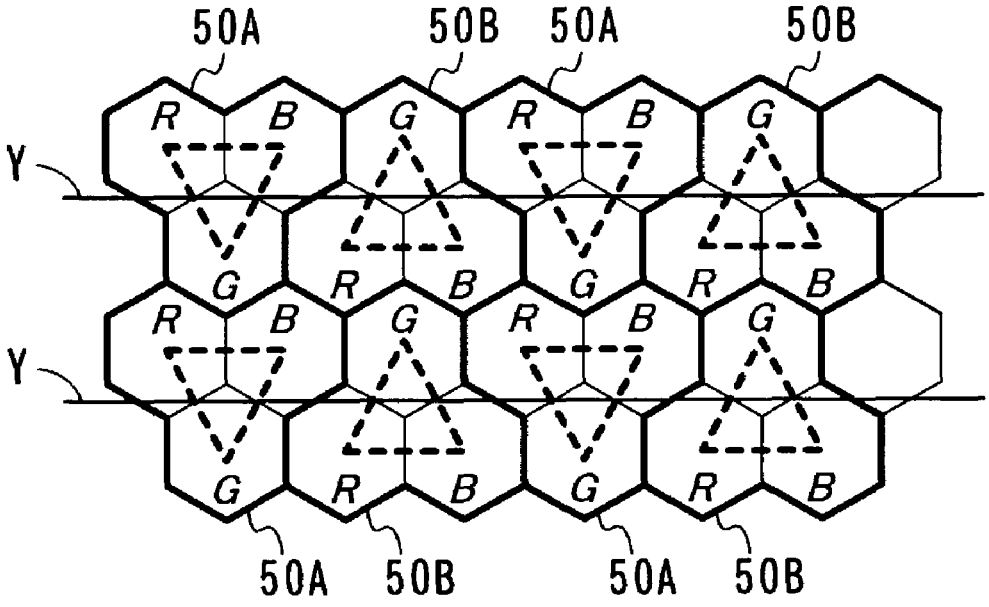
FIG. 5 is a diagram showing a pixel structure of a color display.

FIG. 4 is a schematic diagram of a cell arrangement. FIG. 5 is a diagram showing a pixel structure of a color display.

In FIG. 4, the light emission color of the cell 51 is R (red), the light emission color of the cell 52 is G (green), and the light emission color of the cell 53 is B (blue). As shown in FIG. 4, in the PDP 1, the cell array that is a set of cells corresponding to each column space, i.e., cells aligned in the vertical direction have the same light emission color, light emission colors of neighboring cell arrays are different from each other, and cell positions of the neighboring cell arrays in the column direction are shifted from each other in a set of cell arrays having the same light emission color (e.g., a set of red cells 51). The arrangement form of three colors for a color display is a so-called delta arrangement.

As shown in FIG. 5, the display screen is divided by two cells in the vertical direction and three-cells in the horizontal direction, and pixels (also called dots) 50A and 50B including a group of three cells are constituted. Concerning two neighboring dots 50A and 50B arranged in the horizontal direction, one dot 50A makes a cell group of an inverted triangular arrangement while the other dot 50B makes a cell group of a regular triangle arrangement. In the dot 50A, the centers of the red cell and the blue cell are located at the upper side with respect to the display electrode Y as a scan electrode, while the center of the green cell is located at the lower side. On the contrary in the dot 50B, the center of the green cell is located at the upper side with respect to the display electrode Y, while the centers of the red cell and the blue cell are located at the lower side. Here, the red cell in the dot 50A, the blue cell in the dot 50A and the green cell in the dot 50B are defined as "upper shift cells", while the green cell in the dot 50A, the red cell in the dot 50B and the blue cell in the dot 50B are defined as "lower shift cells".

For display by the PDP 1 having the above-mentioned structure, format conversion and data correction for improving quality of line display are necessary. In addition, if the number of dots in the input image is different from the number of dots in the display screen, resolution conversion is necessary. The data conversion circuit 70 performs convolution operation that also works as these three image processing.

[Structure of Data Conversion Circuit]

Figure 6:
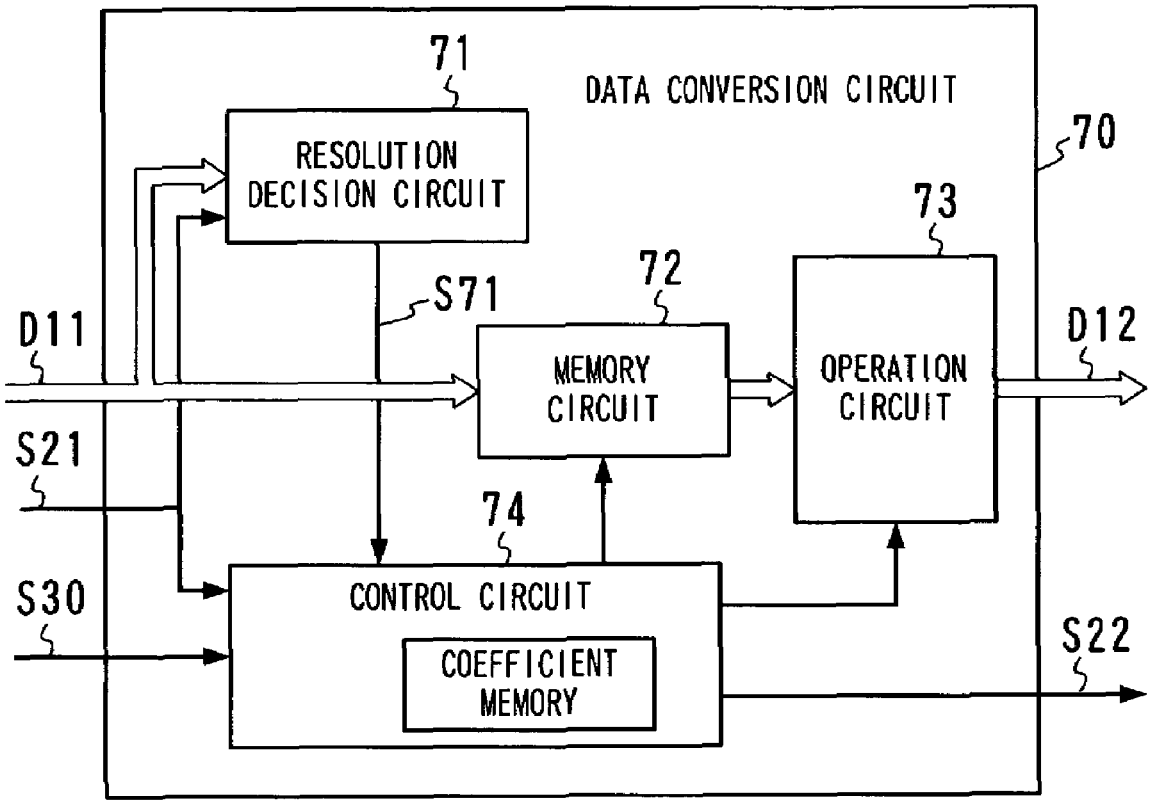
FIG. 6 is a schematic diagram of a data conversion circuit.

FIG. 6 is a schematic diagram of the data conversion circuit. The data conversion circuit 70 includes a resolution decision circuit 71, a memory circuit 72, an operation circuit 73 and a control circuit 74. The data conversion circuit 70 is supplied with image data D11, a synchronizing signal S21 and a user selection signal S30. The user selection signal S30 indicates items set by a user such as switching between a television image input and a computer image input or a desired image quality (sharpness level).

The resolution decision circuit 71 decides the kind of the input image such as a standard television image, a high definition television image, a VGA image, an XGA image or others. If the standard of the image is known, the resolution is also known. Since desired image quality for a television image is different from that for a computer image, it is desirable to perform a process that is suitable for the image. The relationship between a decision signal S71 that is an output of the resolution decision circuit 71 and the corresponding process is determined in advance by evaluating display results of various images in an objective manner. It is possible for a user to select a process in accordance with his or her liking in this example.

Figure 7:
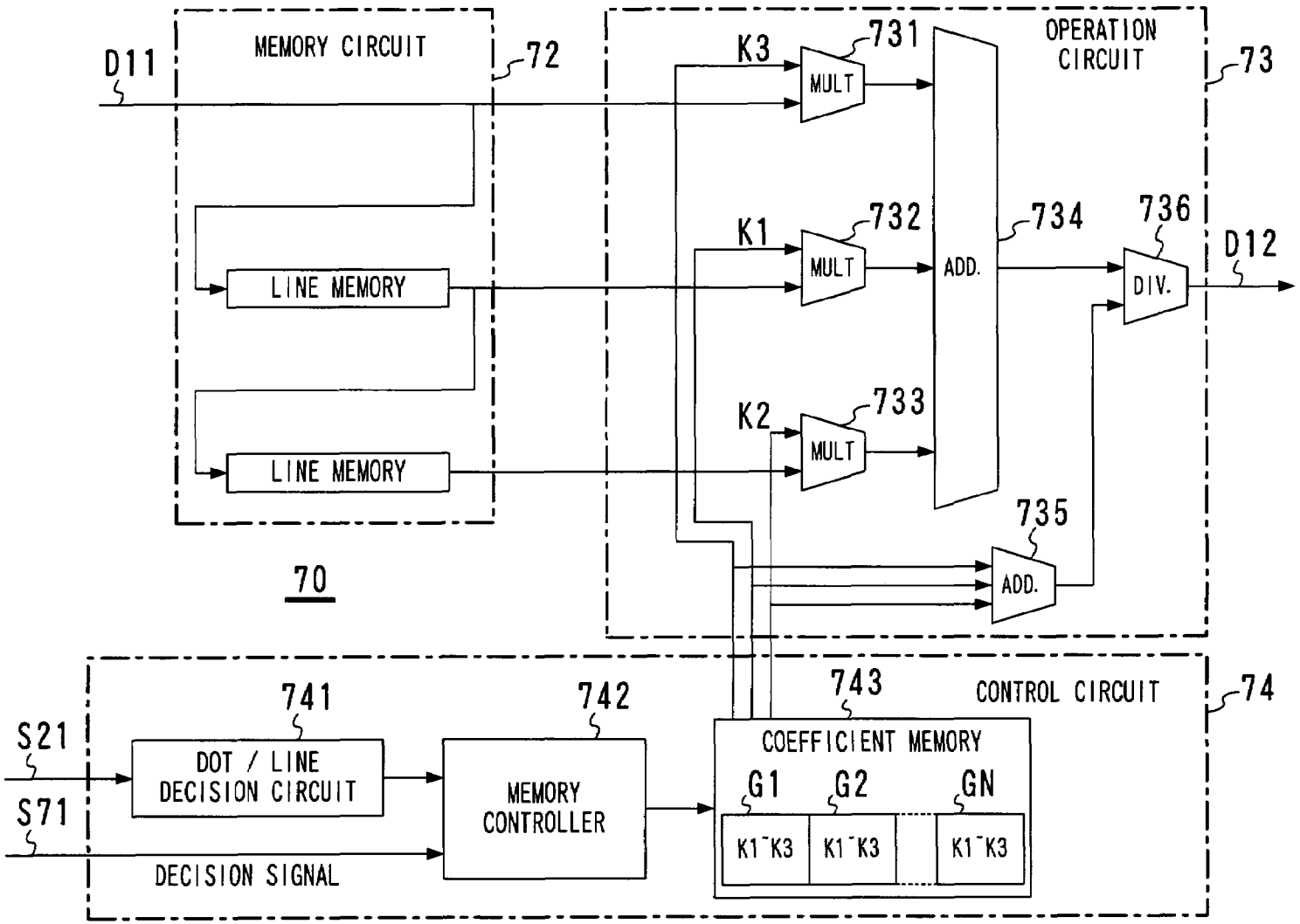
FIG. 7 is a block diagram of an important portion of the data conversion circuit.

FIG. 7 is a block diagram of an important portion of the data conversion circuit. In FIG. 7, the resolution decision circuit 71 included in the configuration shown in FIG. 6 is omitted, and other portions are illustrated in detail. In FIG. 7, MULT denotes a multiplier, ADD. denotes an adder, and DIV. denotes a divider. The memory circuit 72 includes a two-stage line memory for memorizing input data of two lines, outputs image data D11 that are entered in the order of the dot arrangement in real time, and outputs image data D11 to which delay time of one-line transmission time is added as well as image data D11 to which delay time of two-line transmission time is added. In this way, data of dots having the same position in the horizontal direction in total three lines are given to the operation circuit 73 at the same time. In the operation circuit 73, the multiplier 731, 732 or 733 multiplies the input data by a coefficient K1, K2 or K3. The coefficients K1, K2 and K3 constitute one of coefficient sets G1, G2, . . . GN that are memorized in a coefficient memory 743 of the control circuit 74 in advance. The output from the multipliers 731, 732 and 733 are added by the adder 734 and the result is input to the divider 736. The adder 735 and the divider 736 constitute an operational circuit for normalizing output of the adder. In the control circuit 74, a dot/line decision circuit 741 decides a line position and a dot position of the data responding to the data input to the operation circuit 73. In accordance with a combination of the output of the dot/line decision circuit 741 and the decision signal S71 from the previous stage, the memory controller 742 reads a set of coefficients K1, K2 and K3 out of the coefficient memory 743. In the case of an intermittent operation that will be explained later, the coefficient that is given to the multiplier 731, 732 or 733 is switched every other dot, while it is switched every dot in the case of a continuous operation. The configuration is not limited to the illustrated configuration in which the coefficients K1, K2 and K3 are added to the multipliers 731, 732 and 733 when the sum of the coefficients K1, K2 and K3 (K1+K2+K3) is calculated by the adder 735 and given to the divider 736. It can be the configuration in which the sum of the coefficients is calculated for all coefficient sets and is memorized in the coefficient memory 743 in advance, and the coefficient set and the sum of the coefficients are read out to be given to the operation circuit 73.

The image data D11 that are entered includes R data, G data and B data for one dot. The data of one dot are transmitted in series in the order of R, G and B, which can be processed in one operation circuit 73 sequentially. In this case, the circuit shown in FIG. 7 can be only one. Alternatively, there can be three circuits shown in FIG. 7, so that R data, G data and B data can be processed in parallel. In this case, the dot/line decision circuit 741, the memory controller 742 and the coefficient memory 743 can be common for three circuits, if three different operation processes can be performed at the same time. If three circuits are disposed, the rate of the operation process can be three times faster (the process time can be one third) compared with the case where only one circuit is disposed.

[Format conversion]

In general, an image source is prepared on the precondition that the image is displayed on a square arrangement screen. In order to display a square arrangement image, the data conversion circuit 70 performs the format conversion from the square arrangement to the delta arrangement. The square arrangement means a screen structure in which a dot is made of a set of R, G and B cells, and a dot shape is square. In contrast, the delta arrangement means a screen structure in which cell centers are shifted in the vertical direction for each cell in the horizontal direction in a group of calls having the same light emission color as explained above, and the delta arrangement screen includes an upper shift cell and a lower shift cell.

Figure 8A:
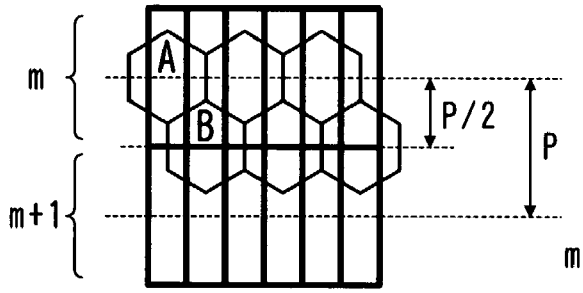
FIGS. 8A and 8B are explanatory diagrams of the format conversion from the square arrangement to the delta arrangement.
Figure 8B:
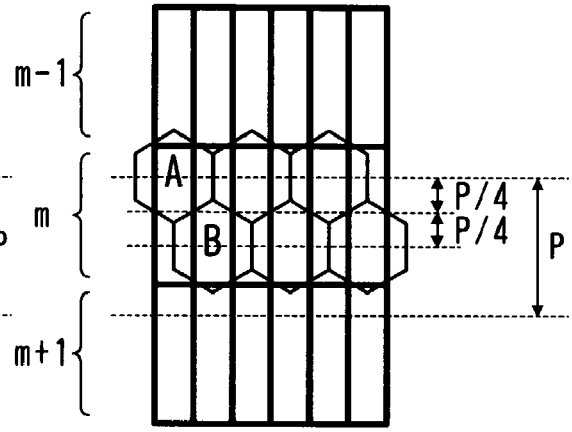

FIGS. 8A and 8B are explanatory diagrams of the format conversion from the square arrangement to the delta arrangement. FIG. 8A shows a conversion process for aligning the upper shift cell A to the cell center of square arrangement screen (alternatively, the lower shift cell B may be aligned). FIG. 8B shows a conversion process for aligning the center of the cell pair that includes the upper shift cell A and its neighboring lower shift cell B in the vertical direction to the center of the cell of the square arrangement screen in the vertical direction. In order to realize the present invention, one of these two processes is performed, or both the processes are performed by switching.

In FIG. 8A, since the upper shift cell A is located on the m-th line in the square arrangement screen, data of the m-th line in the square arrangement screen are distributed without any change. Concerning the lower shift cell B, since it is located over the m-th line and the (m+1)th line, an average value of the m-th line data and the (m+1)th line data is distributed. Since the process is not performed substantially for the upper shift cell A but is performed only for the lower shift cell B, the operation becomes an intermittent operation that is performed every other cell.

In FIG. 8B, since the upper shift cell A is located over the (m−1)th line and the m-th line, a weighted average of data of these two lines is calculated and is distributed. Similarly for the lower shift cell B, a weighted average of data of the m-th line and the (m+1)th line is calculated and is distributed. Since the process is performed for both the upper shift cell A and the lower shift cell B, the operation becomes a continuous operation.

Figure 9:
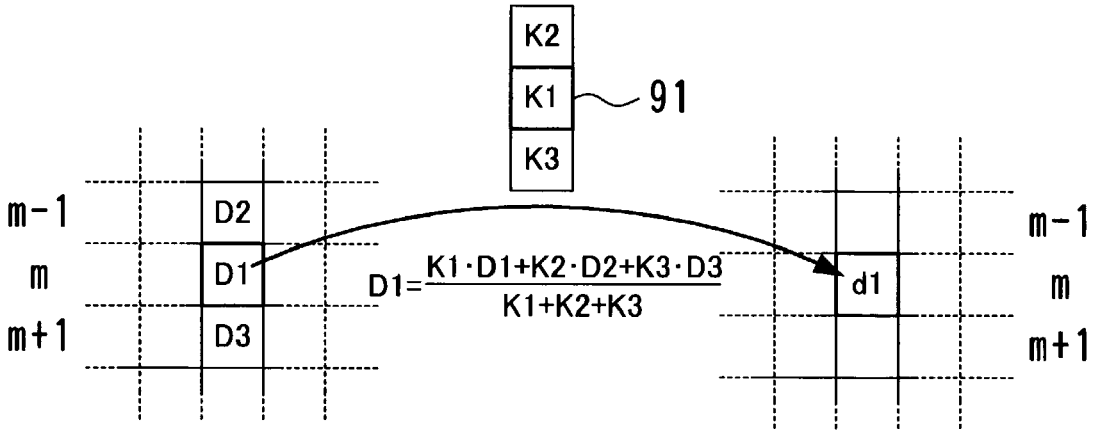
FIG. 9 is an explanatory diagram of the convolution operation.

FIG. 9 is an explanatory diagram of the convolution operation. Since the above-mentioned memory circuit 72 has a two-line data delay function, the operation can be performed on the basis of three dots that have the same dot position in the horizontal direction and neighbor in the vertical direction among the (m−1)th line, the m-th line and the (m+1)th line. The luminance values D1, D2 and D3 of the noted dot and its upper and lower dots of the input image are read, and an operation matrix 91 having coefficients K1–K3 that are determined for each dot position is used for calculating a display luminance value d1 of the noted cell in the display screen. The operation equation is $d1=(K1\times D1+K2\times D2+K3\times D3)/(K1+K2+K3)$. The coefficients K1–K3 are selected properly, so that various lighting patterns can be obtained. In the operation, it is important to exchange the coefficient properly in accordance with the shifted state of the noted dot (the upper shift cell or the lower shift cell).

[Data Correction]

Figure 10A:
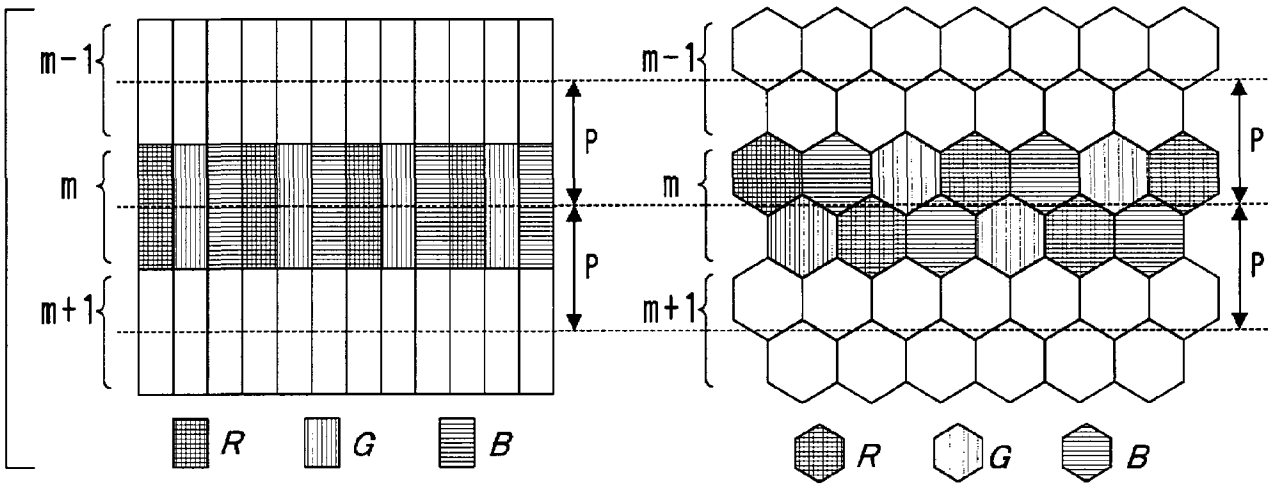
FIGS. 10A and 10B show a lighting pattern of the line display in the square arrangement screen and a lighting pattern of a simple line display in the delta arrangement screen.
Figure 10B:
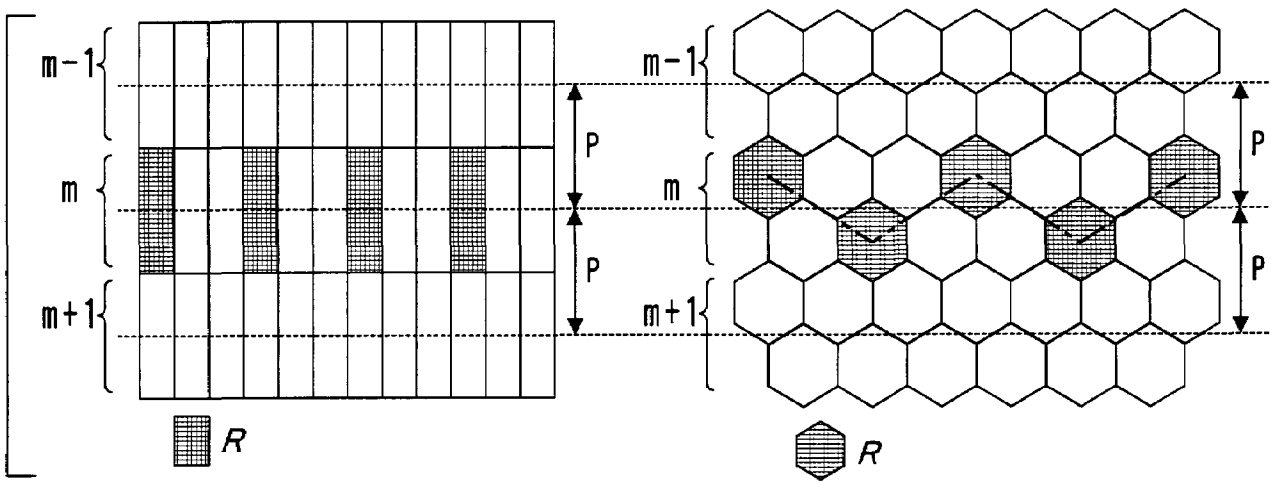

First, the necessity of correction will be explained. FIGS. 10A and 10B show a lighting pattern of the line display in the square arrangement screen and a lighting pattern of a simple line display in the delta arrangement screen. The left sides of FIGS. 10A and 10B are the square arrangement screens, and the right sides are the delta arrangement screens. As shown in FIG. 10A, in the display of a horizontal line of a white color, since the white color is a mixed color of three colors (three cells of a dot are lighted), the display is observed as a straight line in the delta arrangement substantially in the same way as in the square arrangement. Namely, the display quality is good. In contrast, concerning the display of a horizontal line pattern of a color (red color, green color or blue color) that is expressed by light emission of one cell, the display of the delta arrangement screen can be observed as a zigzag line as shown in FIG. 10B. In order to solve this problem, the data conversion circuit 70 performs data correction by the convolution operation.

Figure 11A:
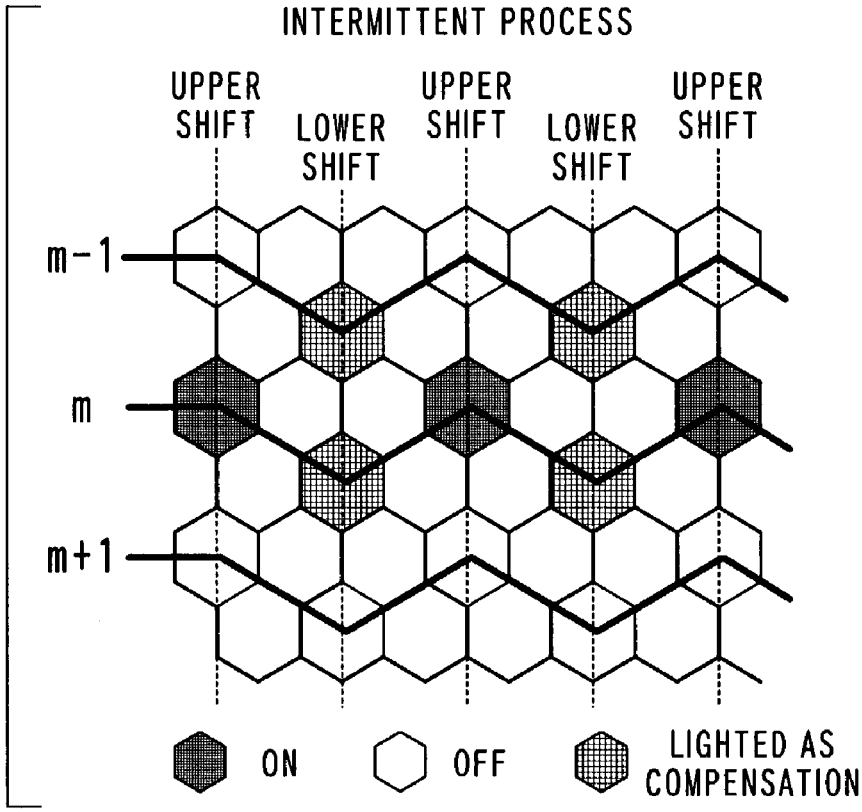
FIGS. 11A and 11B show a lighting pattern of a single light emission color line display in the delta arrangement screen in which the data correction is performed.
Figure 11B:
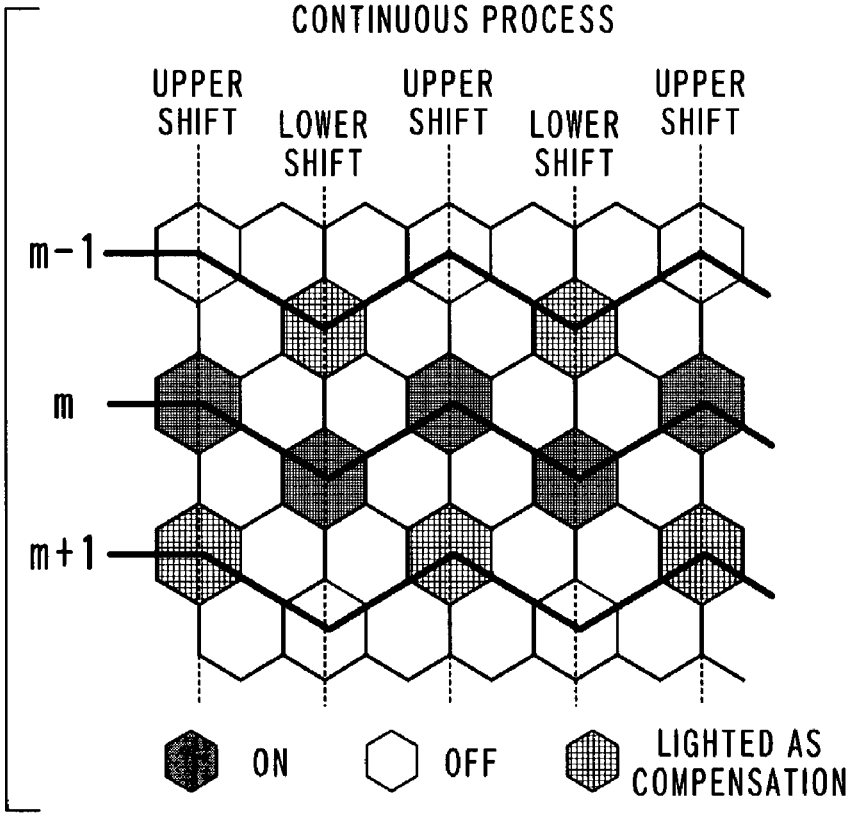

FIGS. 11A and 11B show a lighting pattern of a single light emission color line display in the delta arrangement screen in which the data correction is performed.

It is supposed that an intermittent operation process is performed. The input image includes a horizontal line pattern in which cells of only one color (e.g., red color) are lighted among m-th lines in the square arrangement screen (see FIG. 10B).

The upper shift cell is set in the unfinished state, and an average value between the lower shift cell and its lower neighboring cell is calculated. As the coefficients (K2, K1 and K3), (0, 1, 0) may be adopted for the upper shift cell, and (0, 1, 1) may be adopted for the lower shift cell. As shown in FIG. 5, since R and B cells are the upper shift cells in the first dot, the coefficient set (0, 1, 0) is adopted for these cells. Since G cell is the lower shift cell, the coefficient set (0, 1, 1) is adopted for this cell. In the second dot, R and B cells are the lower shift cells, and G cell is the upper shift cell. Therefore, these two coefficient sets should be exchanged. In a display according to such an operation, the light luminance becomes a half in the portion in which the lower shift cell is lighted as shown in FIG. 11A, and at the same time its upper cell is lighted as compensation at the remaining half luminance. Thus, the barycenter position of the two lighted cells in the vertical direction of the lower shift cell agrees with the position of the upper shift cell in the vertical direction. As a result, a jitter in a display of a horizontal line pattern can be reduced. A similar effect can be obtained in a display of an inclined line pattern.

Next, it is supposed that the continuous operation is performed. As an example of the coefficient set (K2, K1 and K3), (1, 3, 0) is adopted for the upper shift cell, while (0, 3, 1) is adopted for the lower shift cell. In this case, the input luminance data of the (m−1)th line are added a little to the luminance data of the upper shift cell in the m-th line, and the input luminance data of the (m+1)th line are added a little to the luminance data of the lower shift cell. In a display according to such an operation, upper and lower neighboring cells of each of the lighted upper shift cell and the lower shift cell are lighted as compensation by distributing a part of the luminance of the original lighted cell as shown in FIG. 11B. As a result, jitter in a display of a horizontal line pattern can be reduced. A similar effect can be obtained in a display of an inclined line pattern. Though the ratio of the coefficients K2 and K3 to the coefficient K1 is set to 3:1 in the example, other ratio can be set for controlling the compensation lighting luminance, so that characteristics of image correction can be adjusted.

[Resolution conversion]

The number of dots in the VGA image is 640×480, and the number of dots in the vertical direction (i.e., the number of lines) 480 is approximately 500. Similarly, the number of lines in the XGA image (1024×768) is approximately 750, and the number of lines in the high definition TV 1080i (1920×1080) is approximately 1000. Therefore, if the PDP 1 has the VGA specification for example, resolution conversion (more specifically, resolution conversion in the vertical direction) of 3:2 or 2:1 is necessary for the XGA image display or the high definition TV display, respectively. Also, if the PDP 1 has XGA specification, resolution conversion of 2:3 is necessary for the VGA image display.

FIGS. 12A and 12B show data conversion operation timings. The example shown in FIG. 12A is the case where the resolution conversion of 3:2 is performed, and the example shown in FIG. 12B is the case where the resolution conversion of 2:3 is performed. The data conversion circuit 70 shown in FIG. 7 is supplied with an input image in the order of lines (A, B, C, D, . . . ). The data conversion circuit 70 performs the operation after data of plural lines necessary for the convolution operation are prepared and outputs data of the display lines a, b, c, d, . . . . The operation form is a so-called pipeline operation.

In FIG. 12A, data of the line A are memorized in the line memory of the first stage when the data of the line A are entered. Next, when the data of the line B are entered, the data of the line A are transferred to the line memory of the second stage, and the data of the line B are memorized in the line memory of the first stage. Next, when the data of the line C are entered, data of the line A, the line B and the line C are used for the operation, and the result of the operation is outputted as data of the display line a. At the same time, data of the line B are transferred to the line memory of the second stage, and data of the line C are memorized in the line memory of the first stage. The form of memorizing into the line memory is overwriting form, so the data that were used for the operation disappear when new data are memorized. When data of the line D are entered, operation in accordance with data of the line B, the line C and the line D is performed in parallel with data writing into the line memories of the first and the second stages. The operation result is outputted as data of the display line b. In this way, according to the data conversion of the present invention, output data of two lines are generated by using input data of four lines in the resolution conversion for obtaining two output lines per three input lines. Namely, the data conversion circuit 70 performs convolution operation in accordance with data of (M+1) lines in the resolution conversion of an integer ratio M:N (M>N). Thus, the format conversion, data correction and the resolution conversion can be performed simultaneously. In other words, an image processing that works as the three processes can be realized.

Similarly in FIG. 12B, data of the line A and the line B are memorized in series, and data of the display line a are generated in parallel with input of data of the line C. However, the operation for generating data of the display line a is performed in accordance with data of the line A and the line B. Data of the display line b are generated in accordance with data of the line B and the line C. In this way, according to the data conversion of the present invention, output data of one line are generated by using input data of three lines in the resolution conversion for obtaining three output lines per two input lines. Namely, the data conversion circuit 70 performs convolution operation in accordance with data of (M+1) lines also in the resolution conversion of an integer ratio M:N (M<N).

Next, concrete values of the coefficients K1, K2 and K3 in the convolution operation and its effect will be explained.

Figure 13A:
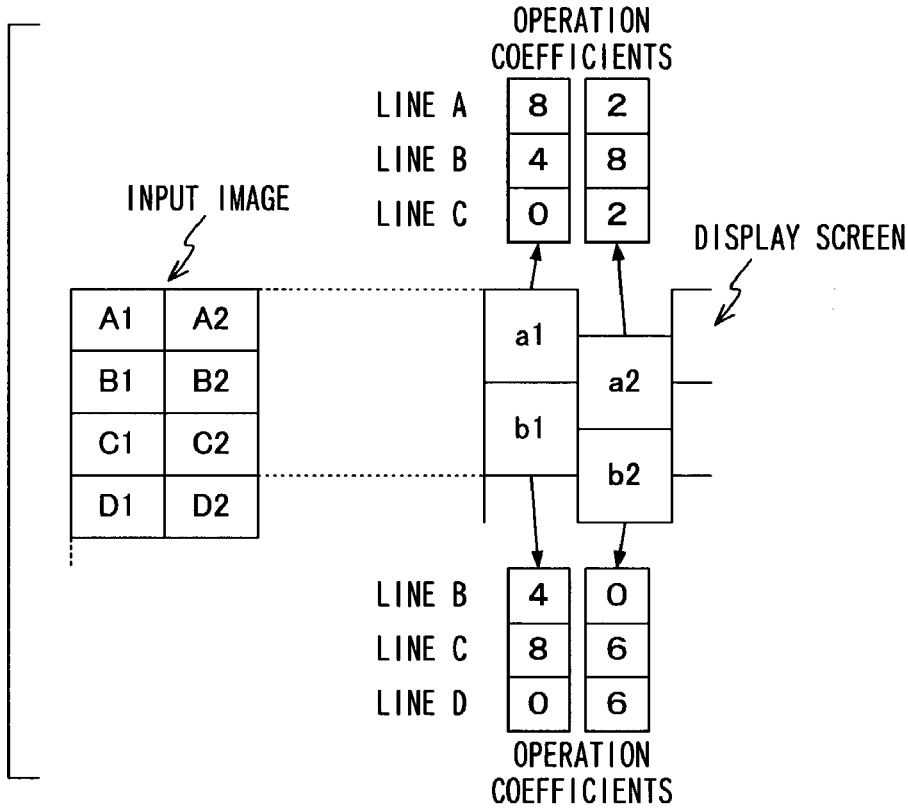
FIGS. 13A and 13B show examples of operation in the case where the resolution conversion of 3:2 is performed.
Figure 13B:
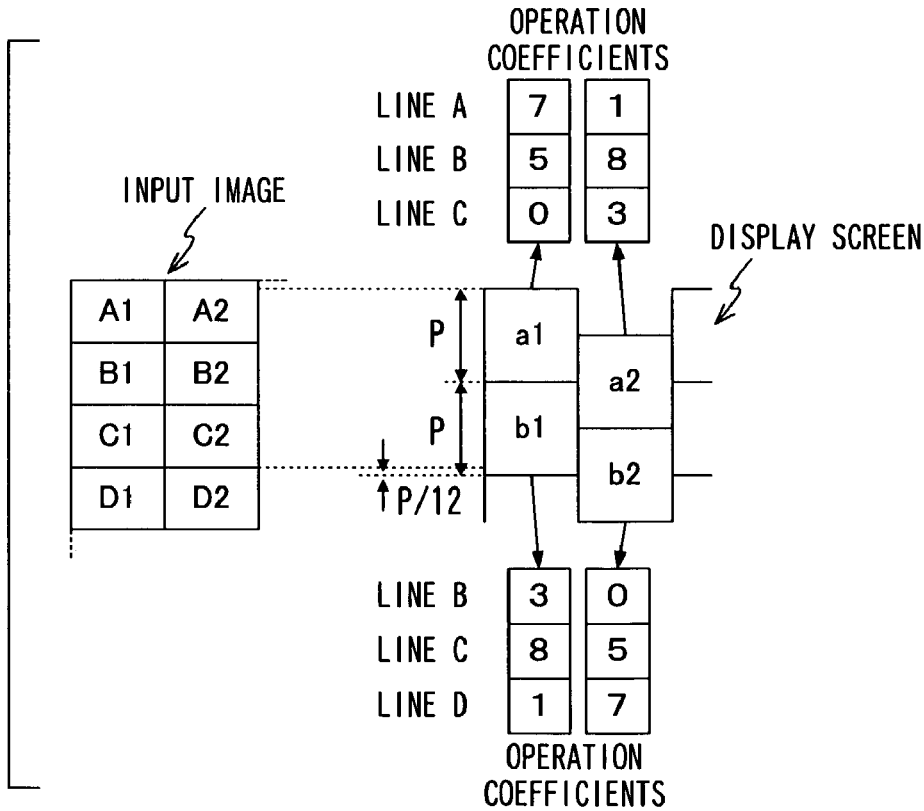

FIGS. 13A and 13B show examples of operation in the case where the resolution conversion of 3:2 is performed. The above-mentioned operation that is also format conversion, data correction and resolution conversion is realized by the illustrated coefficient set. However, concerning the position relationship in the horizontal direction, a dot of the input image and a cell of the display screen are identical to each other. Concerning the position relationship in the vertical direction, there are two cases. In one case, the center position of any one of the cells in the display screen is identical to the center position of a dot of the input image as shown in FIG. 13A. In another case, the center position of any one of the cells in the display screen is not identical to the center position of a dot of the input image as shown in FIG. 13B.

In FIG. 13A, the center position of the cell a2 in the display screen, i.e., the boundary between the cell a1 and the cell b1 matches the center position of the line B (having dots B1, B2 and B3) in the input image. The operation in the case shown in FIG. 13A is as the following equations.

$$a1=(8\times A1+4\times B1)/12$$

$$a2=(2\times A2+8\times B2+2\times C2)/12$$

$$b1=(4\times B1+8\times C1)/12$$

$$b2=(6\times C2+6\times D2)/12$$

In FIG. 13B, the cell position of the display screen is shifted by one twelfth of the pitch p from the position shown in FIG. 13A. The operation in the case shown in FIG. 13B is as the following equations.

$$a1=(7\times A1+5\times B1)/12$$

$$a2=(1\times A2+8\times B2+3\times C2)/12$$

$$b1=(3\times B1+8\times C1+1\times D1)/12$$

$$b2=(5\times C2+7\times D2)/12$$

In the operation a set of three coefficients is used for one cell. The coefficient set is switched between the upper shift cell and the lower shift cell. In addition, the coefficient set is switched every display line in the resolution conversion of 3:2. Therefore, two sets and two sets (total four sets) of coefficients are used for two kinds of cells grouped by the shifted state (the upper shift cell and the lower shift cell).

Figure 14A:
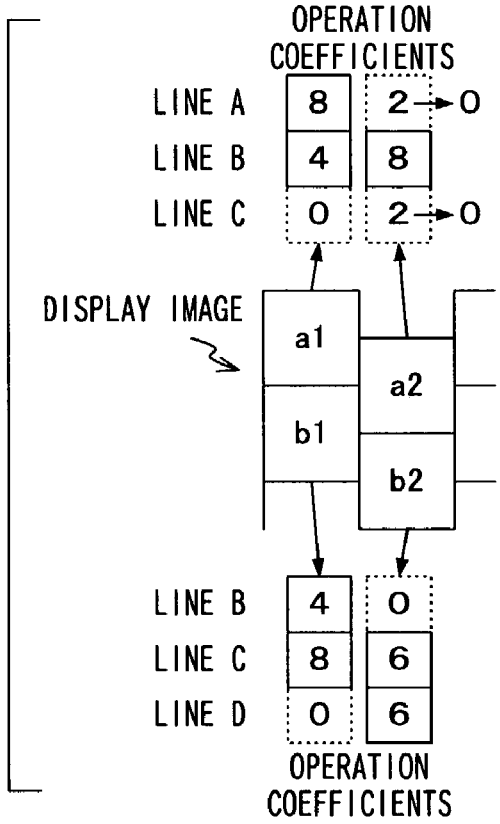
FIGS. 14A and 14B show simplification of the operation.
Figure 14B:
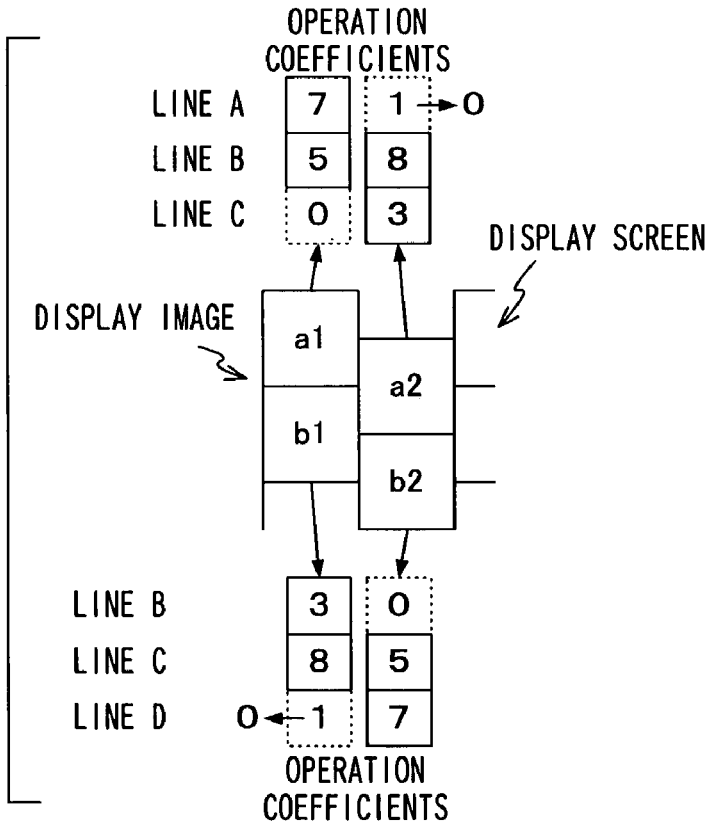
Figures 15A, 15B, 15C, 15D:
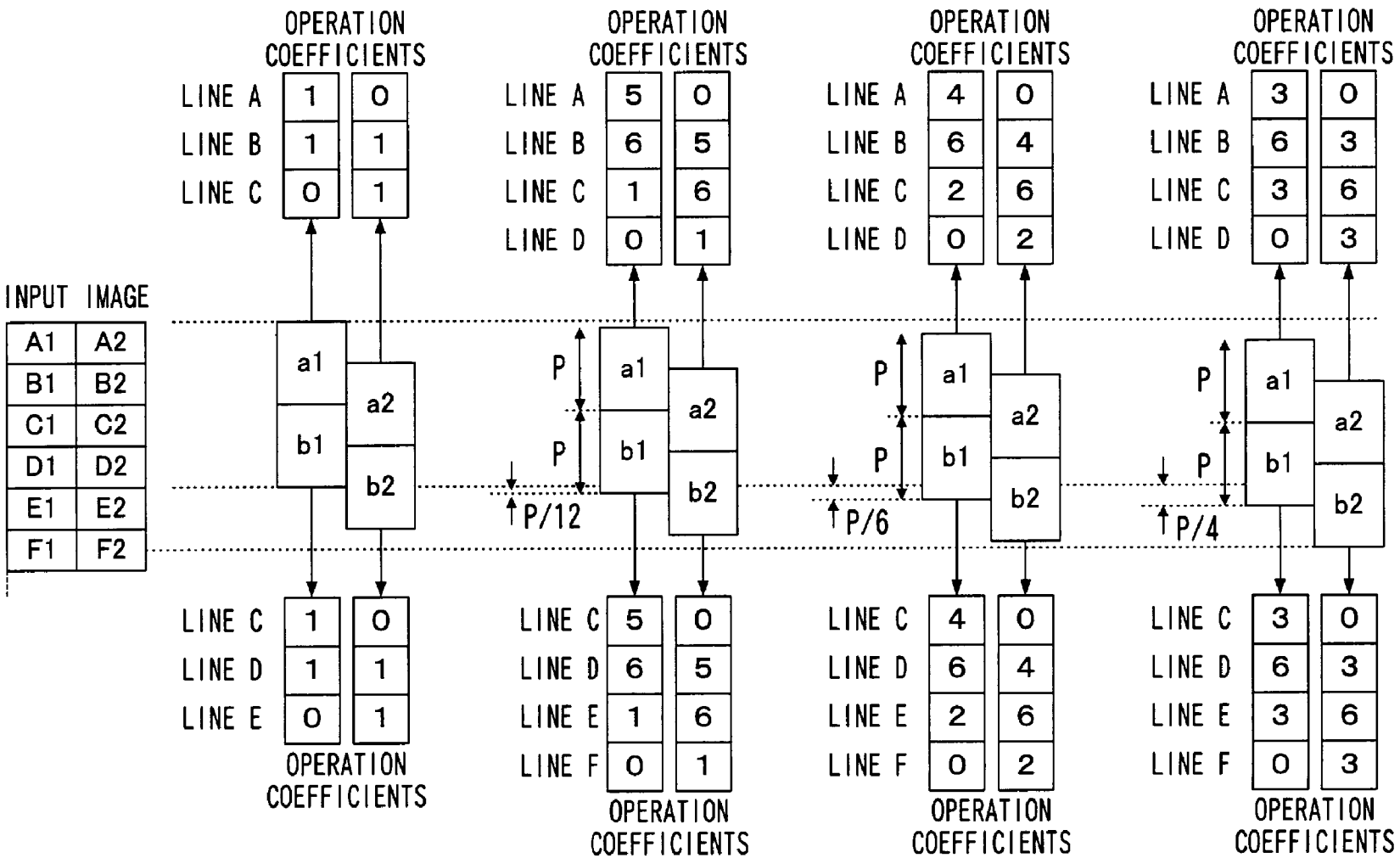
FIGS. 15A to 15D show an example of the operation in which the resolution conversion of 2:1 is performed.
Figures 16A, 16B, 16C, 16D:
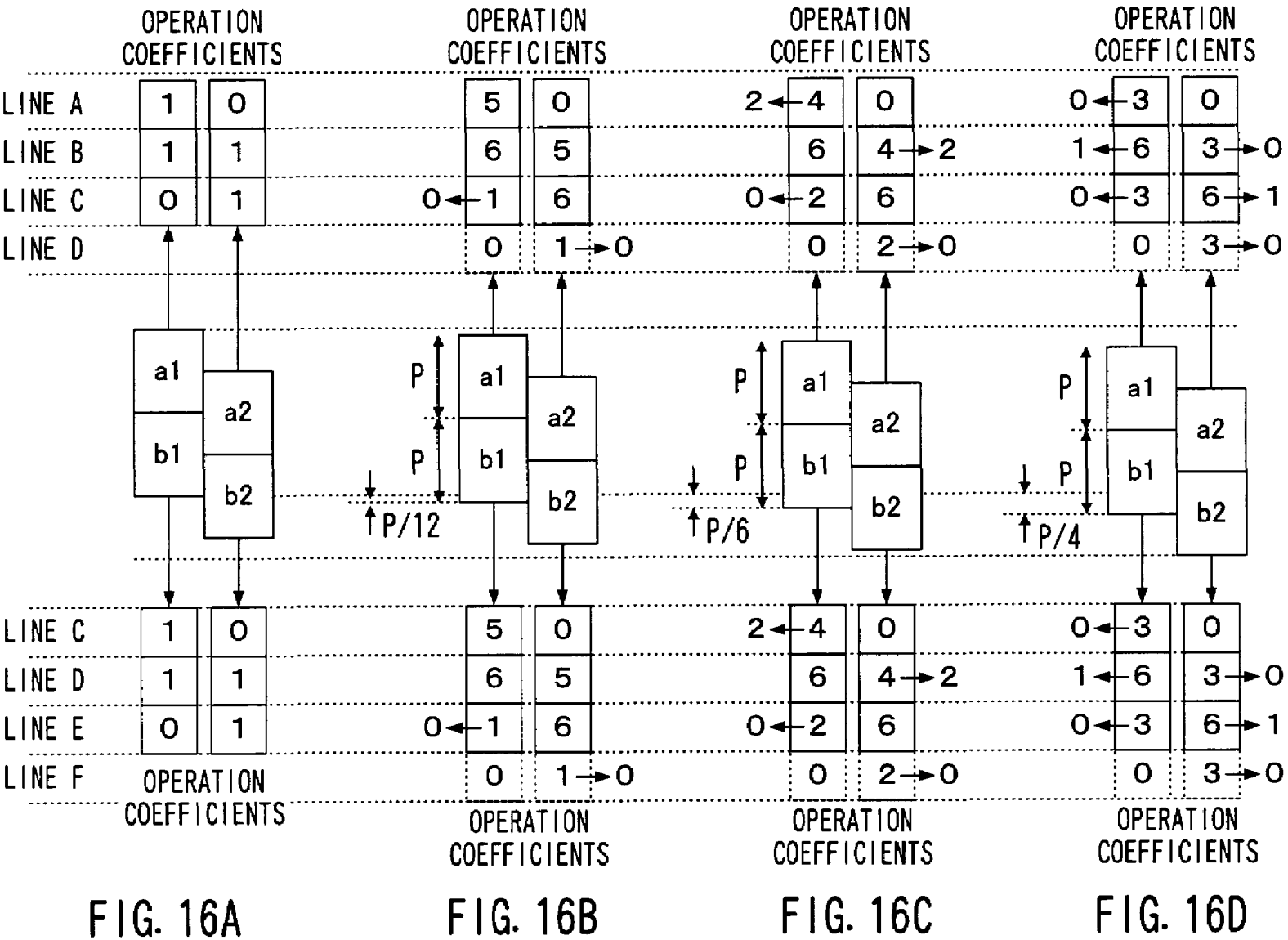
FIGS. 16A to 16D show simplification of the operation.

FIGS. 14A and 14B show simplification of the operation. Among the coefficients shown in FIGS. 13A and 13B, one having a small value, e.g., two or smaller has little influence to luminance, even if the value is made zero. By omitting a coefficient having a small value, memory capacity for the coefficients can be reduced.

FIGS. 15A to 15D show an example of the operation in which the resolution conversion of 2:1 is performed. In FIGS. 15A to 15D, the coefficient sets for four cells a1, a2, b1 and b2 of the display screen are shown in agreement with FIGS. 14A and 14B. Actually, coefficient values of two cells a1 and a2 may be determined in the conversion of 2:1. Coefficient values of cells b1 and b2 are the same as the coefficient values of the cells a1 and a2. Similarly to FIGS. 14A and 14B, concerning the position relationship in the horizontal direction, it is supposed that a dot of the input image and a cell of the display screen are matched. Concerning the position relationship in the vertical direction, there are several cases. In the case A, a display line is identical to two lines of the input image. In the case B, the display line is shifted downward from two lines of the input image by one twelfth of the pitch. In the case C, the display line is shifted downward from two lines of the input image by one sixth of the pitch. In the case D, the display line is shifted downward from two lines of the input image by one fourth of the pitch (The center position of a cell of the display screen is identical to the center position of a dot of the input image).

The operation in the case A is as the following equations.

$$a1=(1\times A1+1\times B1)/2$$

$$a2=(1\times B2+1\times C2)/2$$

The operation in the case B is as the following equations.

$$a1=(5\times A1+6\times B1+1\times C1)/12$$

$$a2=(5\times B2+6\times C2+1\times D2)/12$$

The operation in the case C is as the following equations.

$$a1=(4\times A1+6\times B1+2\times C1)/12$$

$$a2=(4\times B2+6\times C2+2\times D2)/12$$

The operation in the case D is as the following equations.

$$a1=(3\times A1+6\times B1+3\times C1)/12$$

$$a2=(3\times B2+6\times C2+3\times D2)/12$$

The operation in the case A can be realized by the circuit structure shown in FIG. 7. In order to perform the operation in cases B, C and D, a line memory and a multiplier (MULT) may be added to the circuit structure shown in FIG. 7, so that the coefficients can be multiplied by the data of four lines simultaneously.

FIGS. 16A to 16D show simplification of the operation. Among coefficients shown in FIG. 13, one having a small value is changed to a smaller value. In the above-mentioned operation of the case B, the coefficient value 1 is replaced with the value 0. In the operation of the case C, the coefficient value 6 is not changed, and the other coefficient value is decreased by two. In the operation of the case D, the coefficient value 6 is changed to 1, and the other coefficient value is changed to 0. By this simplification, the number of dots in the input image relevant to the operation of one cell is decreased in the operations of the case C and the case D, so that sharpness of a display can be improved. The coefficients of the operation in any of the cases A, B, C and D become a set of three, so the above-mentioned line memory and the multiplier are not necessary to be added. The resolution conversions in four cases are possible without changing the circuit structure shown in FIG. 7.

Figure 17A:
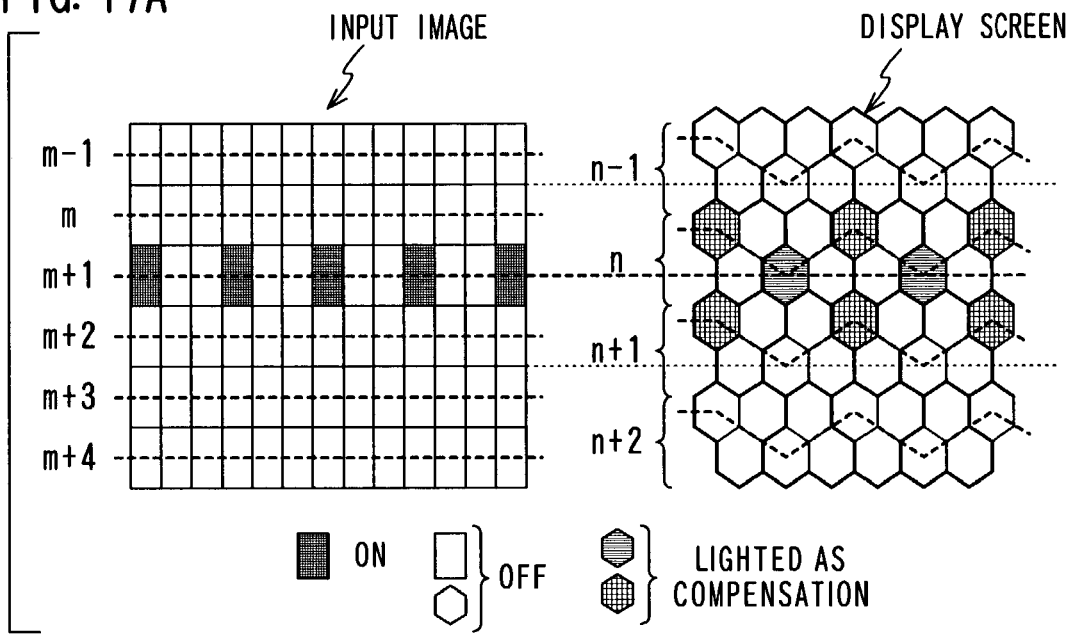
FIGS. 17A, 17B, 18A and 18B show a lighting pattern of a single light emission color line display when the data conversion is performed according to the present invention.
Figure 17B:
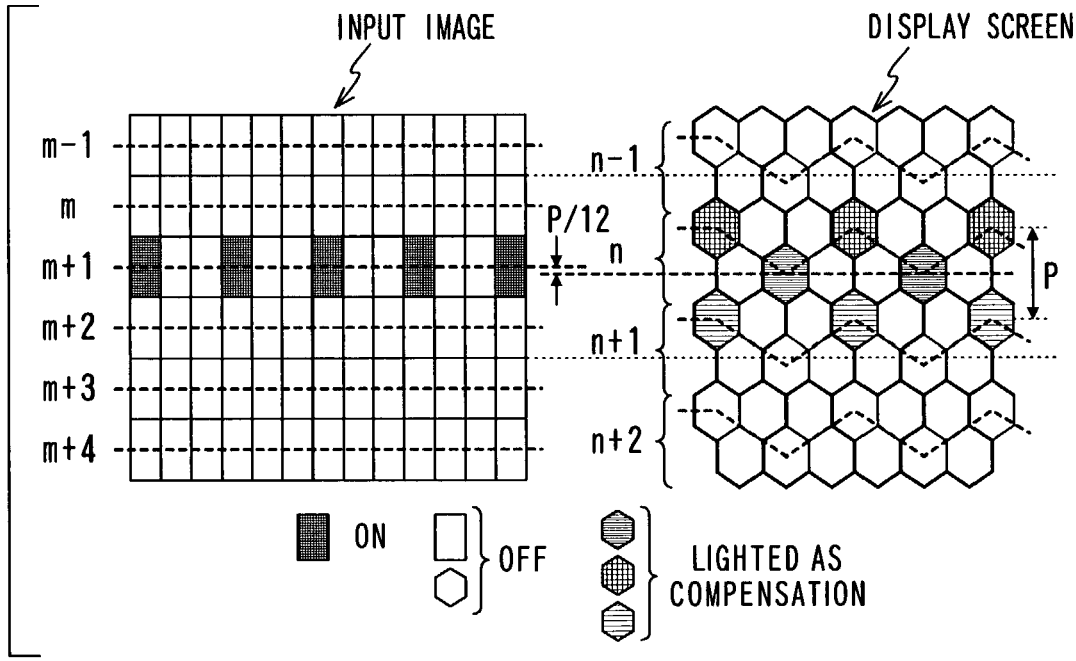
Figure 18A:
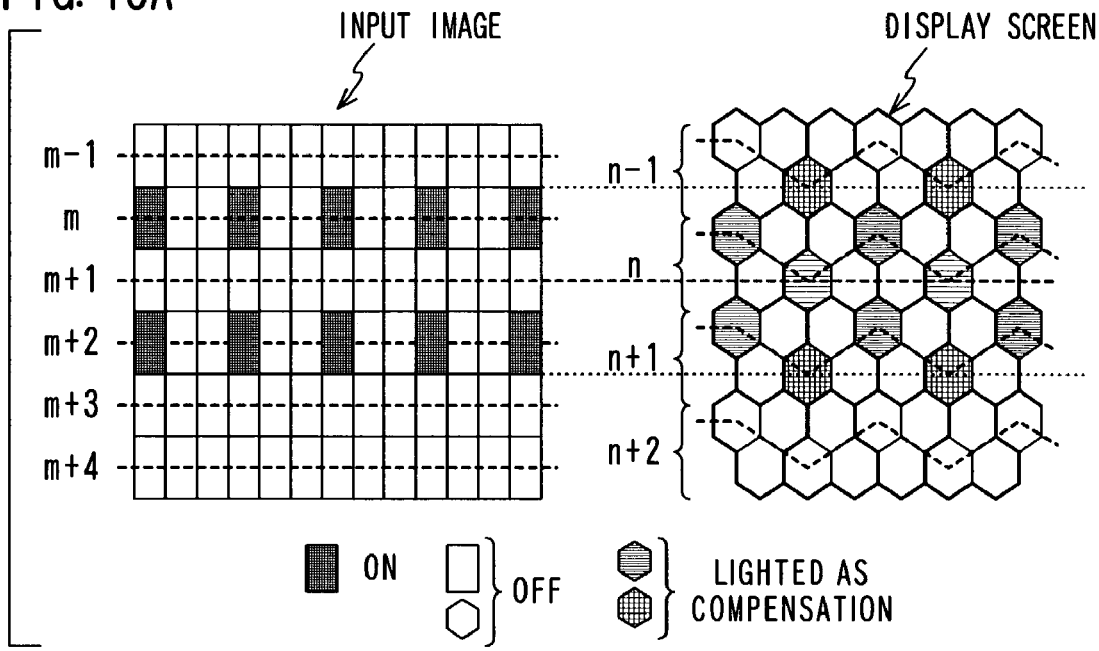
Figure 18B:
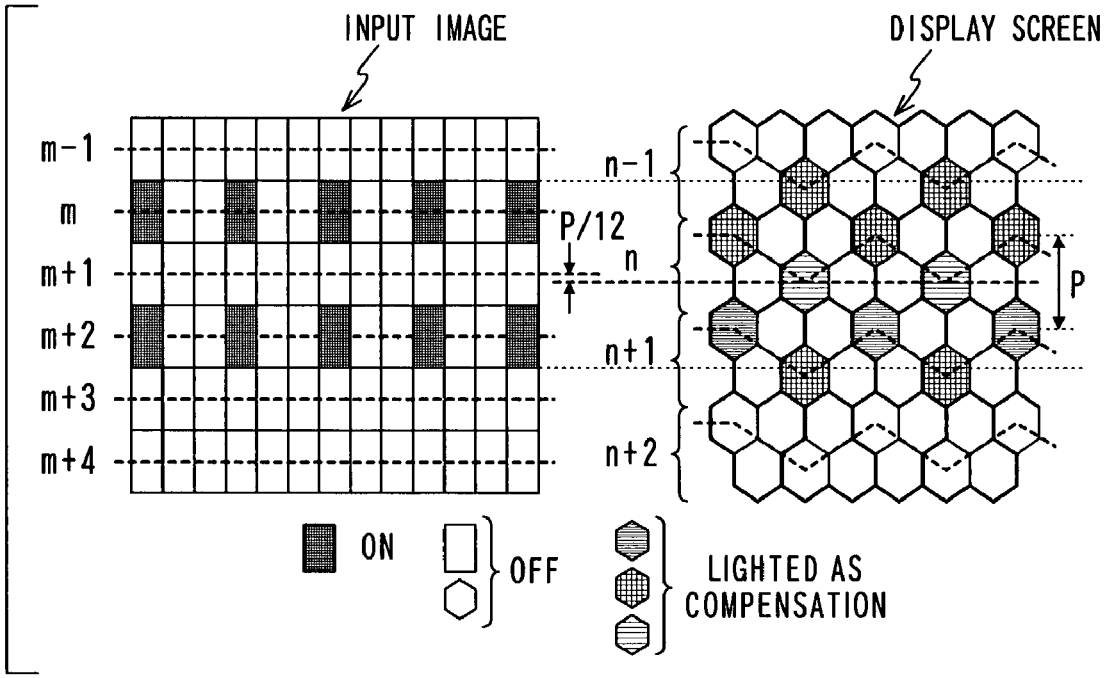

FIGS. 17A, 17B, 18A and 18B show a lighting pattern of a single light emission color line display when the data conversion is performed according to the present invention. FIGS. 17A and 18A show results of data conversion in the intermittent operation including the resolution conversion of 3:2 by using the coefficients shown in FIG. 13A. FIGS. 17B and 18B show results of data conversion in the continuous operation including the resolution conversion of 3:2 by using the coefficients shown in FIG. 13B. The lighting patterns of the input image shown in FIGS. 17A and 17B are the same as in FIG. 10B. It is clear from comparison of FIG. 17 and FIG. 11 that the expansion of the display in the vertical direction is substantially the same as in the case where the resolution conversion is not performed. It is understood that the resolution conversion does not blur a display. The lighting pattern of the input image shown in FIG. 18 is a pattern in which two lines are lighted with a space of one line. Since the expansion of the display of one line in the vertical direction is small as shown in FIG. 17, two lines are observed correctly in a separated manner both in FIG. 18A and in FIG. 18B.

Figure 19:
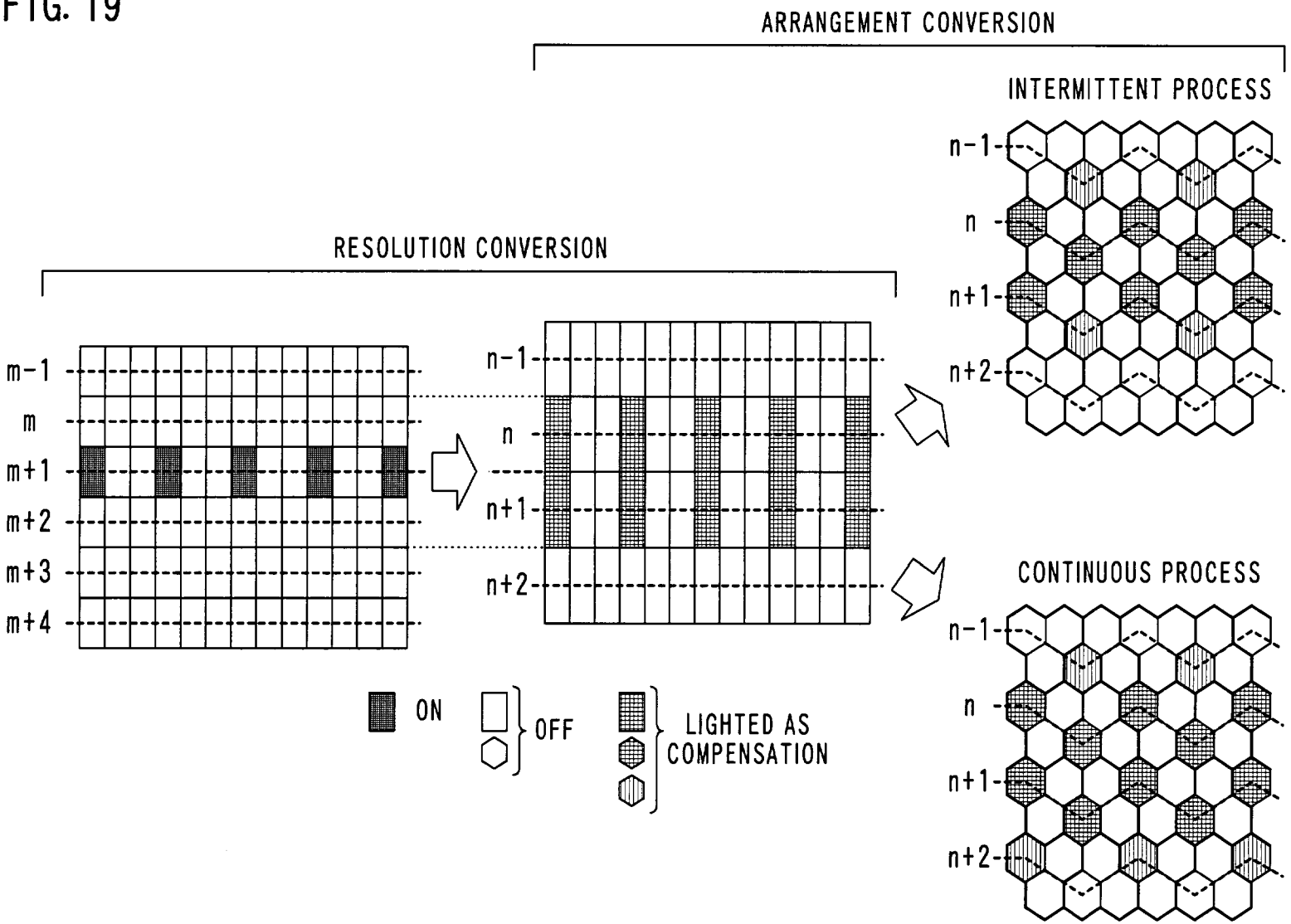
FIGS. 19 and 20 show a lighting pattern of a single light emission color line display when the resolution conversion and the data correction are performed sequentially.
Figure 20:
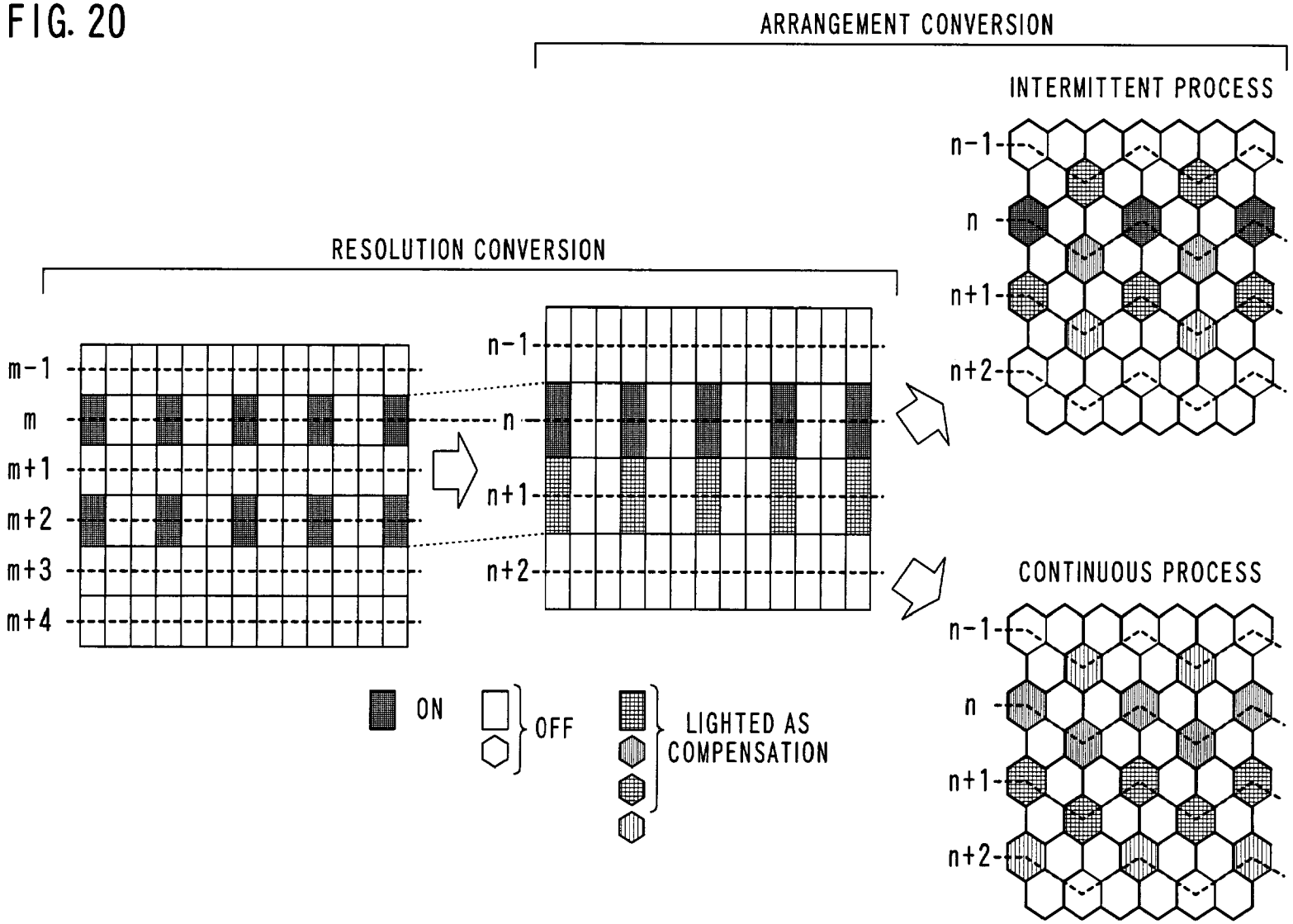

As an example for comparison with the data conversion of the present invention, the case where the resolution conversion and the data correction are performed sequentially is considered. Namely, a circuit structure is supposed in which a correction circuit for a display in the delta arrangement is added as a latter stage circuit to the conventional resolution conversion circuit for a display in the square arrangement. FIGS. 19 and 20 show a lighting pattern of a single light emission color line display when the resolution conversion and the data correction are performed sequentially. The input image in FIG. 19 is the same as in FIGS. 17A and 17B, and the input image in FIG. 20 is the same as in FIGS. 18A and 18B.

In the resolution conversion of 3:2 shown in FIG. 19, the relationship between data $D_m$, $D_{m+1}$, $D_{m+2}$ of the line m, (m+1), (m+2) before the conversion and data $D_n$, $D_{n+1}$ of the line n and (n+1) after the conversion are as the following equations.

$$D_n=(2\times D_m+D_{m+1})/3$$

$$D_{n+1}=(D_{m+1}+2\times D_{m+2})/3$$

In the case of a pattern where the line (m+1) is lighted in the input image as shown in FIG. 19, the resolution conversion makes both the line n and the line (n+1) be lighted at the luminance of one third of the original luminance. When data correction for reducing jitter is further performed, cells on the lines from (n−1) through (n+2) in the display screen are lighted, so that a width of approximately three lines is substantially lighted. Namely, the pattern that was one line lightning in the input image blurs when the width is expanded to three lines in the display screen.

The operation of the resolution conversion of 3:2 shown in FIG. 20 is as the following equations.

$$D_n=D_m$$

$$D_{n+1}=(D_{m+1}+D_{m+2})/2$$

In the case of a pattern where the line m and the line (m+2) are lighted in the input image as shown in FIG. 20, the resolution conversion makes the line n be lighted at the same luminance as the original and the line (n+1) be lighted at a half luminance of the original. When data correction for reducing jitter is further performed, cells on the lines from (n−1) through (n+2) in the display screen are lighted, so that a width of approximately three lines is substantially lighted. Namely, two separated lines in the input image are displayed as one line having blurred width of three lines in the display screen.

It is clear from comparison of FIG. 17 and FIG. 19 as well as comparison of FIG. 18 and FIG. 20 that according to the data conversion of the present invention in which the resolution conversion and the data correction are performed simultaneously, image of a resolution that is different from that of the display screen can be displayed in high quality in a display screen whose cell arrangement is not a square arrangement.

[Variation of Circuit Structure]

Figure 21:
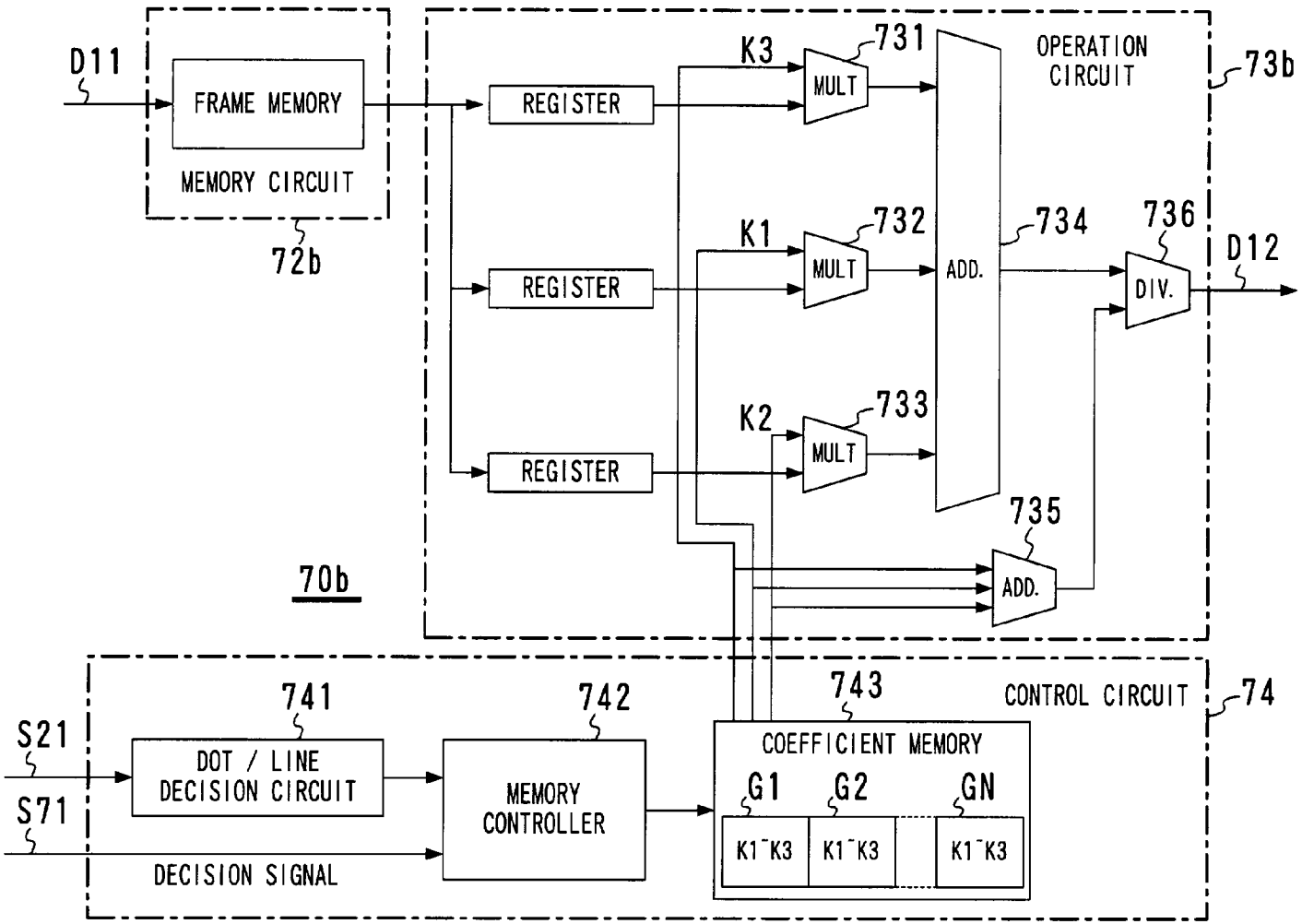
FIG. 21 shows another structure of the data conversion circuit.

FIG. 21 shows another structure of the data conversion circuit. In the data conversion circuit 70*b*, the memory circuit 72*b* is made of a frame memory instead of a line memory. The operation circuit 73*b* has three registers corresponding to three multipliers 731, 732 and 733, respectively. In the structure having a frame memory, the number of lines of data that are used for the operation has no limit, so the operation can be performed in accordance with data of range in the input image that is wider than in the structure shown in FIG. 7. If the input image is high resolution, operation in accordance with data of wide range is desirable. Therefore, by adopting the structure shown in FIG. 21, a device that can support an input image of higher resolution can be provided.

Figure 22:
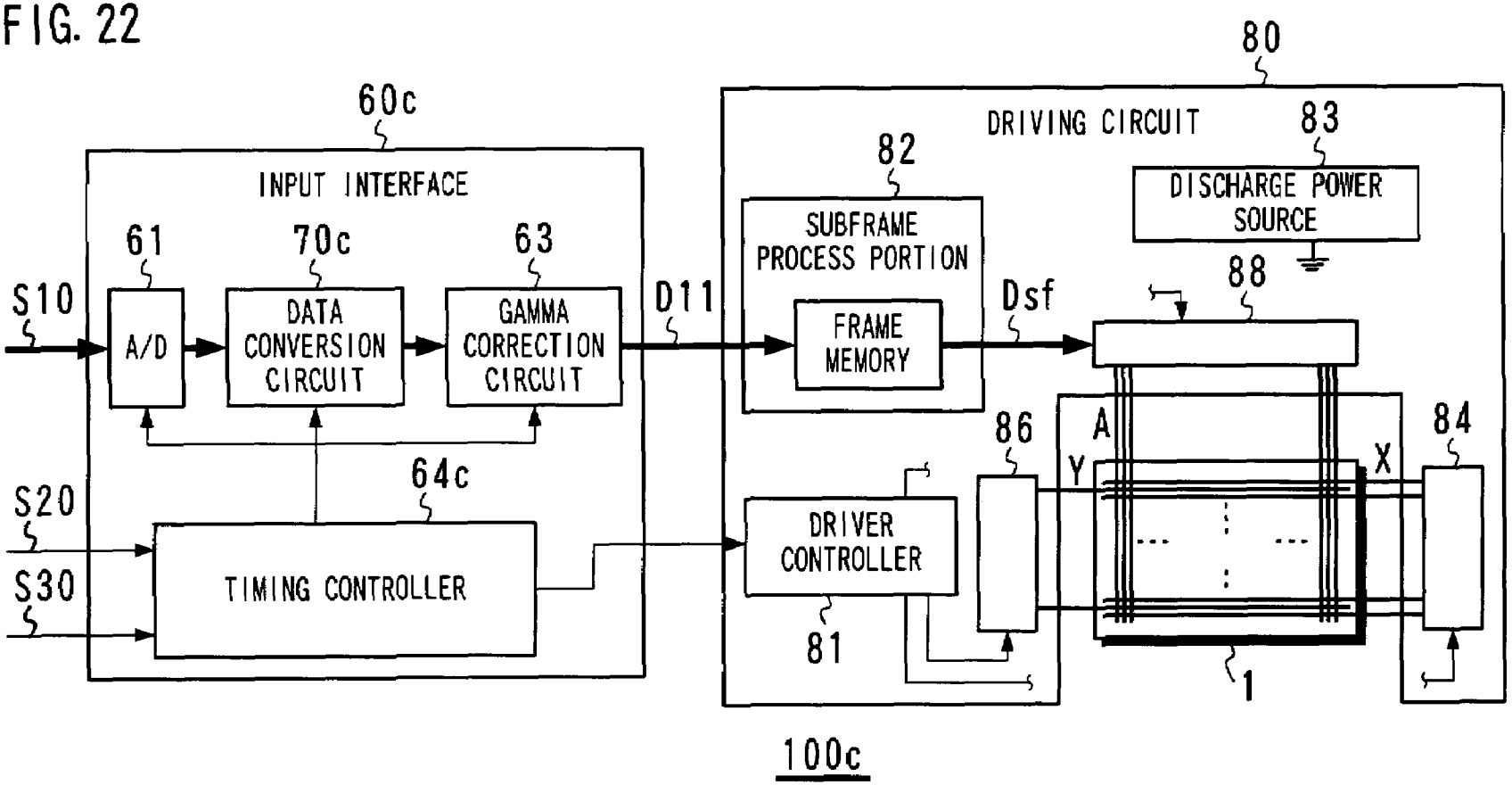
FIG. 22 is a block diagram of another display apparatus according to the present invention.

FIG. 22 is a block diagram of another display apparatus according to the present invention. In the display apparatus 100*c*, the input interface 60*c* is equipped with a data conversion circuit 70*c* that is unique to the present invention. The structure of the data conversion circuit 70*c* can be either the structure shown in FIG. 7 or the structure shown in FIG. 21. The timing controller 64*c* of the input interface 60*c* controls an analog-to-digital converter 61, a data conversion circuit 70*c* and a gamma correction circuit 63. The input interface 60*c* can be made by modifying the conventional input interface for a square arrangement screen having the resolution conversion function. If the line interpolation circuit for the resolution conversion is used as a memory circuit, cost necessary for modifying a circuit for realizing the function of the present invention can be reduced.

Another Embodiment

Figure 23:
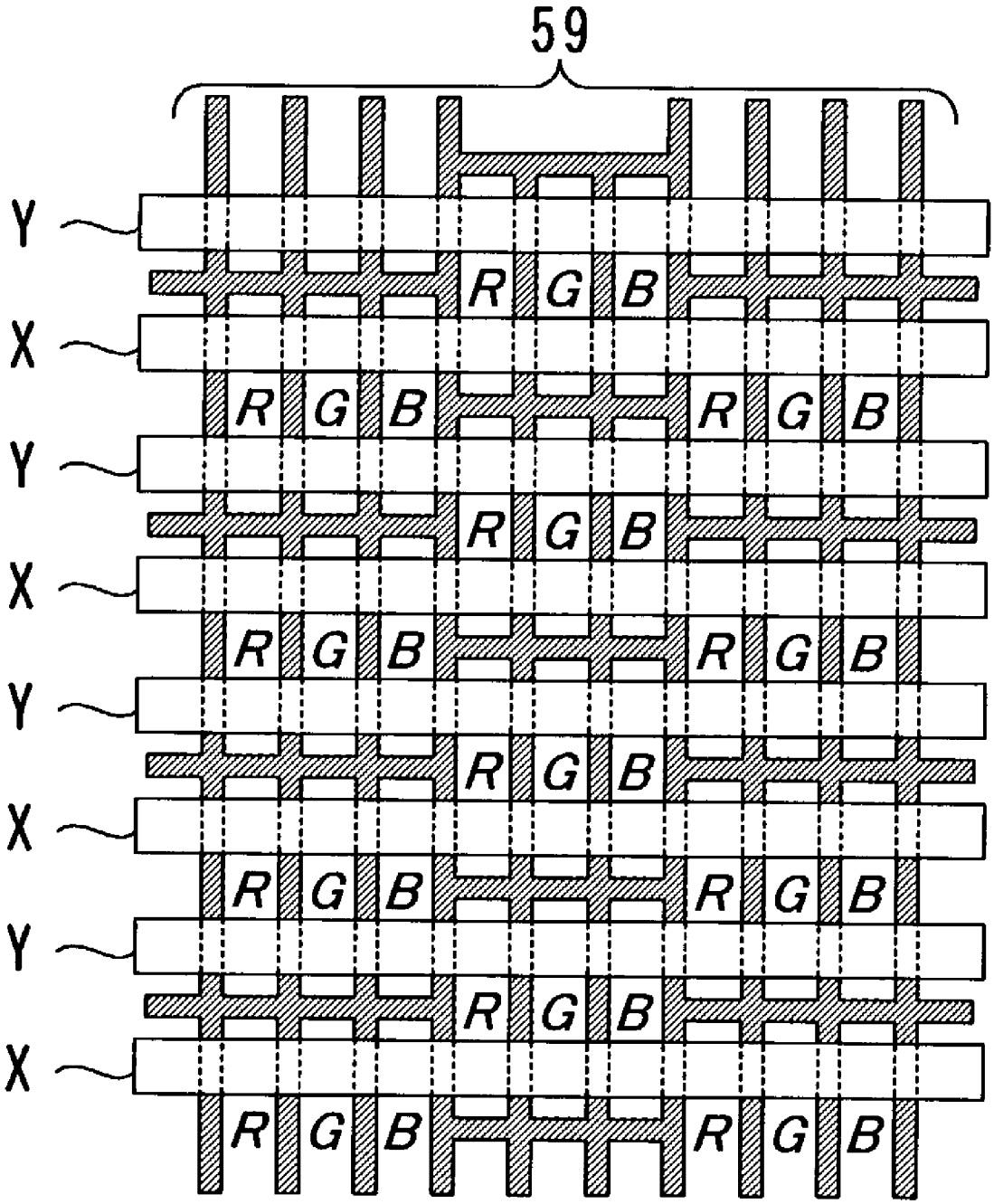
FIG. 23 shows another example of the partition pattern.

In the above-mentioned example, the contents of the operation can be switched in accordance with the kind of the input image (a size, a format and information contents) and user's instruction. The switching can make the display image be high image quality effectively. The present invention can be applied to a display device in which a non-square arrangement display screen is formed by a partition 59 that is a set of linear band-like walls as shown in FIG. 23, without being limited to the device having meandering partitions.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A data conversion circuit for displaying an image whose pixel arrangement is a square arrangement by a display device having a display screen whose cell arrangement is not the square arrangement, wherein the circuit performs addition operation with weighting that is also resolution conversion of an integer ratio M:N and data correction for improving a linear display quality for input image data and wherein N-line data are generated in accordance with (M+1) line input image data.

2. A color image display apparatus for displaying an image that is entered as an image signal form, comprising:

a display device that includes an electrode matrix for display control and has a cell arrangement structure in which cells arranged in one direction of a color display screen have the same color and cell position in the column direction is shifted from each other between neighboring cell arrays having the same color;

an operation circuit for performing addition operation with weighting that is also resolution conversion of an integer ratio M:N and data correction for improving a linear display quality for input image data, said operation circuit including a plurality of multipliers for performing multiplying operation of the image data and an operation coefficient, an adder for adding output of the multiplier and an operational circuit for normalizing output of the adder, and performing the operation for data of plural pixels that neighbor with each other in the column direction of the input image;

an operation control circuit, the operation control circuit including a coefficient memory for memorizing a set of two kinds of coefficients, and the operation in the operation circuit is switched by giving one selected kind of coefficient set to the multiplier for one pixel of the input image data in each line, wherein the coefficient memory memorizes four sets of coefficients including at least two sets for each kind, each of the coefficient sets includes three coefficients for a noted pixel and the neighboring pixels in the column direction, and the operation control circuit gives alternately one and the other of two sets of coefficients having the same kind for each line of the color display screen to the multiplier, so as to realize resolution conversion of the ratio 3:2; and a driving circuit for applying a drive voltage to the electrode matrix in accordance with output data of the operation circuit.

3. The color image display apparatus according to claim 2, wherein the ratio of the coefficients of the first set of the first kind is 2:1:0, the ratio of the coefficients of the second set of the first kind is 1:2:0, the ratio of the coefficients of the first set of the second kind is 1:4:1, and the ratio of the coefficients of the second set of the second kind is 0:1:1, or the ratio of the coefficients of the first set of the first kind is 7:5:0, the ratio of the coefficients of the second set of the first kind is 3:8:1, the ratio of the coefficients of the first set of the second kind is 1:8:3, and the ratio of the coefficients of the second set of the second kind is 0:5:7.

4. A color image display apparatus, comprising:

a display device that includes an electrode matrix for display control and has a cell arrangement structure in which cells arranged in one direction of a color display screen have the same color and cell position in the column direction is shifted from each other between neighboring cell arrays having the same color;

an operation circuit for performing addition operation with weighting that is also resolution conversion of an integer ratio M:N and data correction for improving a linear display quality for input image data, the operation circuit including a plurality of multipliers for performing multiplying operation of the image data and an operation coefficient, an adder for adding output of the multiplier and an operational circuit for normalizing output of the adder, and performing the operation for data of plural pixels that neighbor with each other in the column direction of the input image;

a driving circuit for applying a drive voltage to the electrode matrix in accordance with output data of the operation circuit; and an operation control circuit, the operation control circuit including a coefficient memory for memorizing two sets of coefficients different in kind, and the operation in the operation circuit is switched by giving one selected kind of coefficient set to the multiplier for one pixel of the input image data in each line, wherein each of the coefficient sets memorized by the coefficient memory includes three or four coefficients for a noted pixel and the neighboring pixels in the column direction, and the operation control circuit realizes resolution conversion of the ratio 2:1 by giving one selected kind of coefficient set to the multiplier for one pixel of the input image data in each line.

5. The color image display apparatus according to claim 4, wherein the ratio of the coefficients of the first kind is 1:1:0 and the ratio of the coefficients of the second kind is 0:1:0, or the ratio of the coefficients of the first kind is 5:6:1:0 and the ratio of the coefficients of the second kind is 0:5:6:1, or the ratio of the coefficients of the first kind is 2:3:1:0and the ratio of the coefficients of the second kind is 0:2:3:1, or the ratio of the coefficients of the first kind is 1:2:1:0 and the ratio of the coefficients of the second kind is 0:1:2:1.

* * * * *